US011867478B2

(12) United States Patent
Smith

(10) Patent No.: US 11,867,478 B2
(45) Date of Patent: Jan. 9, 2024

(54) GUNSIGHT WITH ELONGATE LIGHT COLLECTOR

(71) Applicant: HiViz, LLC, Laramie, WY (US)

(72) Inventor: Bradley R. Smith, Timnath, CO (US)

(73) Assignee: HiViz, LLC, Laramie, WY (US)

( * ) Notice: Subject to any disclaimer, the term of this patent is extended or adjusted under 35 U.S.C. 154(b) by 0 days.

(21) Appl. No.: 17/579,352

(22) Filed: Jan. 19, 2022

(65) Prior Publication Data

US 2023/0228523 A1 Jul. 20, 2023

(51) Int. Cl.
*F41G 1/34* (2006.01)

(52) U.S. Cl.
CPC ..... *F41G 1/345* (2013.01)

(58) Field of Classification Search
CPC ..... F41G 1/345; F41G 1/34
USPC ..... 42/132
See application file for complete search history.

(56) References Cited

U.S. PATENT DOCUMENTS

| | | | |
|---|---|---|---|
| 815,090 | A | 3/1906 | Hukill |
| 898,531 | A | 9/1908 | Tufts |
| 1,292,211 | A | 1/1919 | Young |
| 1,346,303 | A | 7/1920 | Trevor et al. |
| 1,363,553 | A | 12/1920 | Barringer |
| 1,818,381 | A | 8/1931 | Caruth |
| 2,706,335 | A | 4/1955 | Munsey |
| 2,970,380 | A | 2/1961 | Hill |
| 3,098,303 | A | 7/1963 | Plisk |
| 3,121,163 | A | 2/1964 | Rickert |
| 3,192,632 | A | 7/1965 | Von Stavenhagen |
| 3,362,074 | A | 1/1968 | Luebkeman et al. |
| 3,641,676 | A | 2/1972 | Knutsen et al. |
| 3,645,635 | A | 2/1972 | Steck |
| 3,678,590 | A | 7/1972 | Hayward |

(Continued)

FOREIGN PATENT DOCUMENTS

| | | |
|---|---|---|
| AT | 507403 | 4/2010 |
| CH | 667150 | 9/1988 |

(Continued)

OTHER PUBLICATIONS

Optics planet.com. SIG Sauer X-RAY1 Enhanced Day Sight Set, No. 6. Website, https://www.opticsplanet.com/sig-sauer-x-ray1-enhanced-day-sight-set.html, originally downloaded Jun. 29, 2022, 3 pages.

(Continued)

*Primary Examiner* — Reginald S Tillman, Jr.
(74) *Attorney, Agent, or Firm* — James B. Conte; Craig R. Miles; CR MILES P.C.

(57) ABSTRACT

A sighting device, such as a gunsight, includes a support. The support includes a surface. The surface has a surface first section and a surface second section. The surface second section forms a curve. A hollow is delimited by the support surface. An access into the hollow is delimited by the support surface. An elongate light collector has a first section connected to a curved second section. The collector further includes a terminal connected to the second section. Also an illuminating surface of the collector resides at the first section. The light collector first section lies on and along the surface first section. The light collector second section lies on and along said curve of the second section. A light generating source resides in the hollow.

22 Claims, 14 Drawing Sheets

(56) References Cited

U.S. PATENT DOCUMENTS

| | | | | |
|---|---|---|---|---|
| 3,698,092 | A | 10/1972 | Rosenhan | |
| 3,700,339 | A | 10/1972 | Steck, III | |
| 3,813,790 | A | 6/1974 | Kaltmann | |
| 3,886,667 | A | 6/1975 | Rueb | |
| 3,905,708 | A | 9/1975 | Steck, III | |
| 3,949,482 | A | 4/1976 | Ross | |
| 4,070,763 | A | 1/1978 | Carts, Jr. | |
| 4,136,963 | A | 1/1979 | Budden et al. | |
| 4,495,705 | A | 1/1985 | Kowalski et al. | |
| 4,536,965 | A | 8/1985 | Tildeblad | |
| 4,574,335 | A | 3/1986 | Frimer | |
| 4,627,171 | A * | 12/1986 | Dudney | F41G 1/345 42/123 |
| 4,745,686 | A | 5/1988 | Willis | |
| 4,745,698 | A | 5/1988 | Schwulst | |
| 4,806,007 | A | 2/1989 | Bindon | |
| 4,877,324 | A | 10/1989 | Hauri et al. | |
| 5,065,519 | A | 11/1991 | Bindon | |
| 5,279,061 | A | 1/1994 | Betz et al. | |
| 5,359,800 | A | 11/1994 | Fisher | |
| 5,440,458 | A | 8/1995 | Volk | |
| 5,500,911 | A | 3/1996 | Roff | |
| 5,548,493 | A | 8/1996 | Young | |
| 5,560,113 | A | 10/1996 | Simo et al. | |
| 5,638,604 | A | 6/1997 | Lorocco | |
| 5,735,070 | A | 4/1998 | Vasquez et al. | |
| 5,752,761 | A | 5/1998 | Pietruczynik et al. | |
| 5,822,872 | A | 10/1998 | Waki | |
| 5,850,700 | A | 12/1998 | Capson et al. | |
| 5,862,618 | A | 1/1999 | Brown | |
| 5,878,503 | A | 3/1999 | Howe et al. | |
| 5,926,963 | A | 7/1999 | Knight | |
| 5,930,906 | A | 8/1999 | Howe et al. | |
| 5,956,854 | A | 9/1999 | Lorocco | |
| 6,005,024 | A | 12/1999 | Anders et al. | |
| 6,014,830 | A | 1/2000 | Brown et al. | |
| 6,035,539 | A | 3/2000 | Hollenbach et al. | |
| 6,058,615 | A | 5/2000 | Uhlmann et al. | |
| 6,058,616 | A | 5/2000 | Bubits | |
| 6,122,833 | A | 9/2000 | Lorocco | |
| 6,216,352 | B1 | 4/2001 | Lorocco | |
| 6,233,836 | B1 | 5/2001 | Uhlmann | |
| 6,358,855 | B1 | 3/2002 | Ramachandran et al. | |
| 6,360,471 | B1 | 3/2002 | Stein | |
| 6,360,472 | B1 | 3/2002 | Lorocco | |
| 6,375,864 | B1 | 4/2002 | Phillips et al. | |
| 6,385,855 | B1 | 5/2002 | Tymianski | |
| 6,412,208 | B1 * | 7/2002 | Mikuta | F41G 1/345 42/132 |
| 6,421,946 | B1 | 7/2002 | LoRocco | |
| 6,446,377 | B1 | 9/2002 | Hollenbah et al. | |
| 6,571,482 | B1 | 6/2003 | Tymianski | |
| 6,581,317 | B1 | 6/2003 | Slates | |
| 6,596,074 | B2 | 7/2003 | Pomeroy | |
| 6,678,987 | B2 | 1/2004 | Howe | |
| 6,684,551 | B2 | 2/2004 | Howe | |
| 7,238,301 | B2 | 7/2007 | Huang et al. | |
| 7,338,877 | B1 | 3/2008 | Meyer et al. | |
| 7,451,566 | B1 | 11/2008 | Price | |
| 7,562,486 | B2 | 7/2009 | LoRocco | |
| 7,627,976 | B1 | 12/2009 | Olson | |
| 7,739,825 | B2 * | 6/2010 | LoRocco | F41G 1/345 42/111 |
| 7,908,783 | B2 | 3/2011 | Howe et al. | |
| D679,359 | S | 4/2013 | Adock, Jr. | |
| 8,425,063 | B2 | 4/2013 | Buckingham et al. | |
| 8,438,775 | B2 | 5/2013 | Howe et al. | |
| 8,635,800 | B2 | 1/2014 | Glimpse et al. | |
| 8,635,801 | B2 | 1/2014 | Glimpse et al. | |
| D700,268 | S | 2/2014 | Hormberg | |
| 8,925,237 | B2 | 1/2015 | Howe et al. | |
| 8,997,393 | B2 | 4/2015 | Bar Yona | |
| 9,644,921 | B1 | 5/2017 | LoRocco et al. | |
| 9,869,525 | B1 | 1/2018 | Howe et al. | |
| 10,088,274 | B2 | 10/2018 | Howe et al. | |
| 10,837,737 | B1 | 11/2020 | Wright | |
| 11,029,129 | B1 * | 6/2021 | Lee | F41G 1/02 |
| 2006/0123687 | A1 | 6/2006 | Howe et al. | |
| 2008/0184609 | A1 | 8/2008 | Schulst | |
| 2009/0013581 | A1 | 1/2009 | LoRocco | |
| 2011/0107650 | A1 | 5/2011 | Howe et al. | |
| 2011/0314721 | A1 | 12/2011 | Lamb | |
| 2012/0151817 | A1 | 6/2012 | Howe et al. | |
| 2012/0198750 | A1 | 8/2012 | Mansfield | |
| 2013/0255129 | A1 | 10/2013 | Curry | |
| 2014/0096430 | A1 | 4/2014 | Kruse | |
| 2015/0153136 | A1 | 6/2015 | Howe et al. | |
| 2018/0053575 | A1 | 2/2018 | Karchon et al. | |
| 2022/0113116 | A1 | 4/2022 | Rohrer | |

FOREIGN PATENT DOCUMENTS

| | | | |
|---|---|---|---|
| DE | 202004011991 U1 * | 12/2004 | F41G 1/345 |
| EP | 0254675 | 1/1988 | |
| GB | 1532090 | 11/1978 | |
| WO | WO 2006/111813 | 10/2006 | |
| WO | WO2010/034458 | 4/2010 | |
| WO | WO2011/067291 | 6/2011 | |
| WO | WO/2019/209535 | 10/2019 | |

OTHER PUBLICATIONS

Meprolight. This backup plan is always in sight. Overview. Website, https://www.meprolight.com/product-ft-bullseye/, originally downloaded Nov. 16, 2021, 2 pages.

PCT International Patent Application No. PCT/US19/26809, International Search Report and Written Opinion of the International Searching Authority dated Oct. 3, 2019, 17 pages.

U.S. Appl. No. 61/459,749, filed Dec. 17, 2010.

U.S. Appl. No. 13/200,628, filed Sep. 26, 2011.

ARO-TEK Ltd. Tri-Lite Day/Night Sight, Catalog, 1997, 3 total pages.

MB-MICROTEC. Tactical Lynx, on-line catalog, www.mbmicrotec.com, originally downloaded May 31, 2011, 3 total pages.

Personal Defense World. Truglo Introduces The new Brite-Site TFX Handgun Sight. Website, http://www.personaldefenseworld.com, originally downloaded Apr. 22, 2015, 5 pages total.

TRUGLO. TFX™ Tritium/Fiber-Optic Day/Night Sights. Website, http://www.truglo.com, originally downloaded Mar. 20, 2015, 1 page.

U.S. Appl. No. 16/147,307, filed Sep. 28, 2018.

U.S. Appl. No. 16/147,307, Office Action dated Sep. 17, 2019.

U.S. Appl. No. 14/579,846, filed Dec. 22, 2014.

U.S. Appl. No. 15/953,374, filed Apr. 13, 2018.

* cited by examiner

GUNSIGHT WITH ELONGATE LIGHT COLLECTOR

I. FIELD OF THE INVENTION

The present disclosure concerns a sighting device which includes an elongate light collector and a support. The light collector includes a first section and a second section. The first section extends on and along a first support surface of the support. The second section extends along and on a second support surface. The second support surface forms a curve having a radius of curvature. The second section extends along and on the curve. The light collector first section includes a surface forming an illuminating sighting reference point.

II. BACKGROUND OF THE INVENTION

The firearms industry employs gunsights using elongate light collectors, such as optical fibers, wherein the optical fiber provides a sighting reference point. The firearm user employs the reference point to reference a target relative to the gun barrel.

U.S. Pat. No. 7,562,486, Jul. 21, 2009, Self-Illuminated Lighting Device, Paul LoRocco, discloses an illuminated sighting device which includes a capsule with an integrally formed lens that is adapted to face rearwardly for viewing by a user. An elongate light collector is positioned within the hollow interior of the capsule and is formed such that light can be gathered along its length and transmitted to its ends. One of the light collector ends is located adjacent to the first lens and defines a sight point or dot. An artificial light source is located within the capsule hollow interior and is oriented for projecting radiant energy into the second light collector end so that the sight point is viewable during dark or low light conditions.

U.S. Pat. No. 7,739,825, Illuminated Sighting Device, Paul LoRocco, discloses an illuminated sighting device which includes an elongate light collector having one end defining a sight point that faces rearwardly for viewing by a user. The light collector is formed such that light can be gathered along its length and transmitted to the one end. The light collector further includes a curved transition section optically coupled with the sight. The curved transition section has a radius of curvature that is sufficiently large to substantially reduce or eliminate light loss from the curved section and thereby increase a brightness of the sight point.

U.S. Pat. No. 9,644,921, May 09, 2017, Sight Assembly With Illuminated Sight Point, Paul LoRocco, discloses a sight assembly for aiming at a distant target by a user which includes a sight housing having a sight window; a lens connected to the housing in alignment with the sight window; a depression formed with the lens; and an illuminated sight point for superimposing on the distant target. The illuminated sight point includes an artificial light source located in the depression. In this manner, the light source is protected from the outside environment to thereby protect the light source against inadvertent separation from the lens.

U.S. Pat. No. 6,216,352, Apr. 17, 2001, Day/Night Weapon Sight, Paul LoRocco, a phosphorescent or light-reflective member is disposed on a holder supporting an elongated light-gathering optical fiber formed of a light-gathering plastic material. The sight is adaptable for use on rifles, handguns, bows, and other weapons requiring an aiming indicium. The light-gathering optical fiber provides a brilliant dot that is readily identifiable under bright light conditions, and the phosphorescent or light-reflecting member provides a supplemental light source which serves to provide an illuminated dot under low-light or dark conditions. The sight effectively solves the problem of providing electrically-powered light sources for illumination of the aiming indicia under low light or dark conditions, or the requirement to precisely align the fiber or hollow tube with a light source disposed at the distal end of the fiber or tube spaced from the viewing end of the fiber or tube.

III. SUMMARY OF THE INVENTION

In one example of the invention, a sighting device, such as a gunsight, includes a support. The support forms a surface first section and a surface second section. The surface second section forms a curve. The support further includes a hollow and an access into said hollow; each delimited by surface of the support. The gunsight further includes an elongate light collector with a first section connected to a curved second section. The collector includes a terminal connected to the second section and an illuminating surface at the first section. A connector connects to the support. A light generating source resides proximate the terminal. The light collector first section lies on and along the surface first section. The light collector second section lies on and along the curve of the second section. The light generating source resides in the hollow.

In a further example of the invention the support includes a carrier. The surface first section and the surface second section are formed with the carrier. An enclosure delimits an open space. The open space has a first and an opposite second access opening into the open space. The enclosure is formed with the carrier. The elongate light collector is in the enclosure.

In yet a further embodiment, the surface first section forms a first section of a first surface portion of the carrier. The surface second section forms a second section of the first surface portion of the carrier. The enclosure forms a first enclosure having an end surface delimiting the first access.

The elongate light collector first section forms a first section of a first elongate light collector. The elongate light collector second section forms a second section of the first elongate light collector. The terminal forms a terminal of the first elongate light collector. The illuminating surface forms an illuminating surface of the first elongate light collector.

The sighting device further includes a second elongate light collector. The second elongate light collector has a first section connected to a curved second section. A terminal connects to the second section. An illuminating surface resides at said first section.

The support further includes a second surface portion having a first and second section. The second section has a curve. The first and second section of the second surface portion are formed with the carrier. A second enclosure, formed with the carrier, delimits an open space. The open space has a first and an opposite second access. An end surface delimits the first access. The second light collector first section is in the open space delimited by the second enclosure. The first and second enclosure delimit an open space of a sighting notch. The end surfaces of the enclosures form an entry into the open space of said sighting notch.

Naturally, further objects and constructions of the invention are disclosed throughout other areas of the specification, drawings, photographs, and claims.

IV. BRIEF DESCRIPTION OF THE DRAWINGS

V DETAILED DESCRIPTION OF THE INVENTION

Figure 1A:
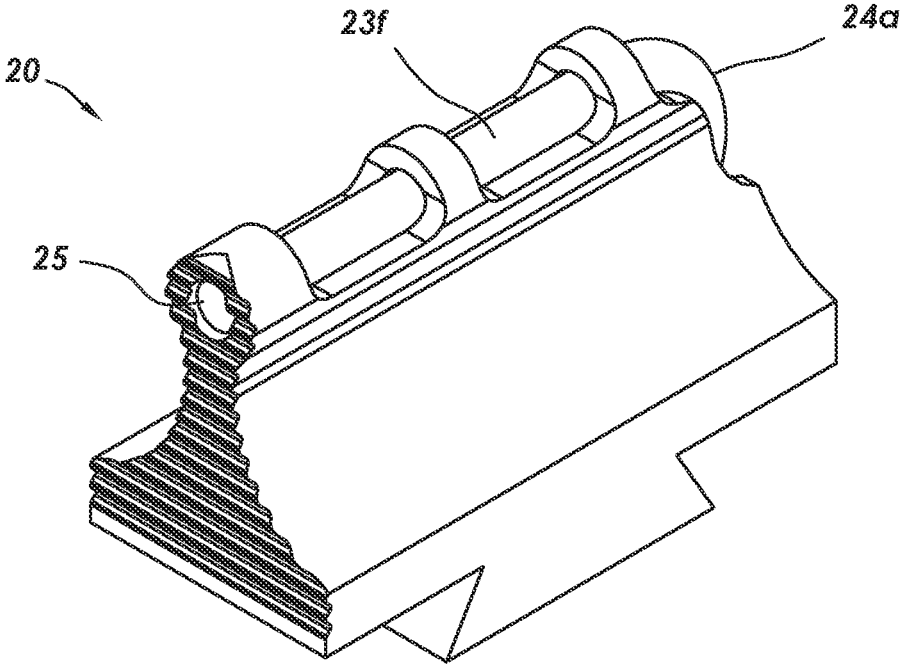
FIG. 1A is an isometric view of a front gunsight having a support connected to a singular elongate light collector looking into a first end of the gunsight embodying features of the present invention.
Figure 1B:
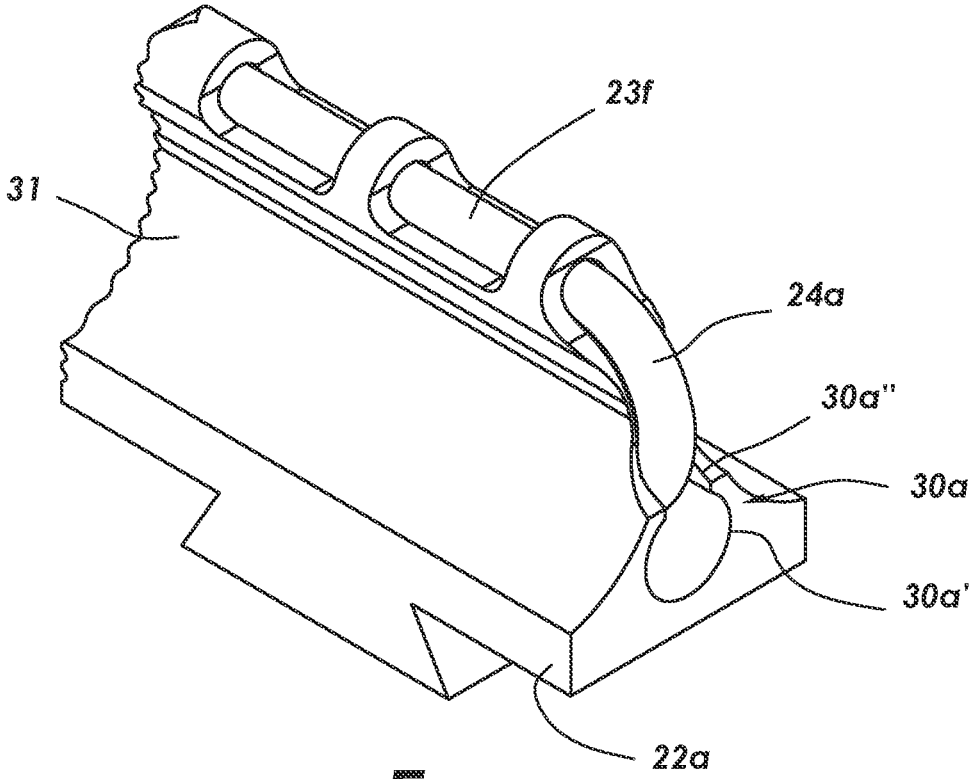
FIG. 1B is an isometric view of the front gunsight having the support connected to the singular elongate light collector shown in FIG. 1 looking into an opposite second end of the gunsight.
Figure 2:
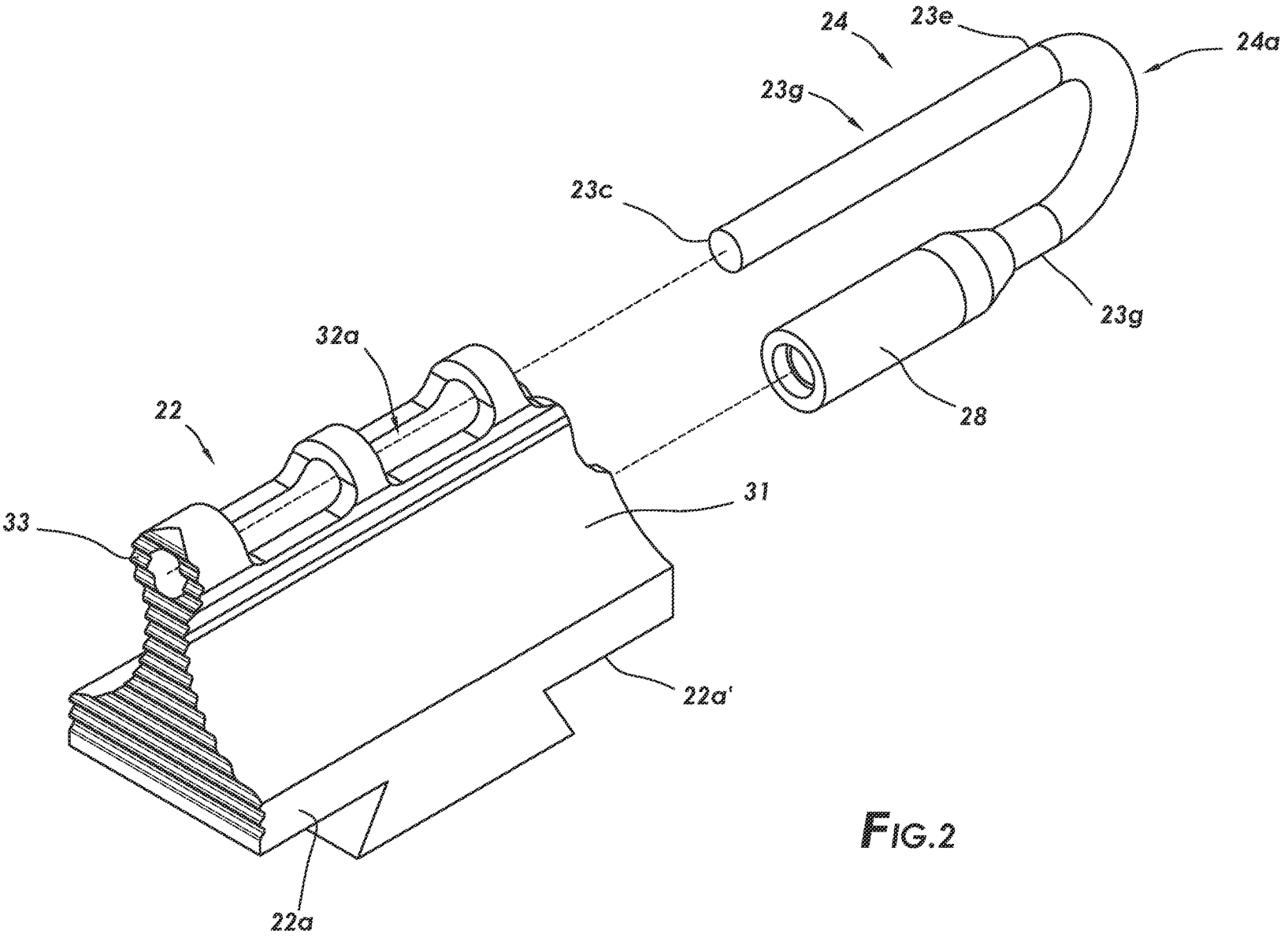
FIG. 2 is the isometric view of the gunsight shown in FIG. 1 wherein the light collector is exploded off the support.
Figure 3A:
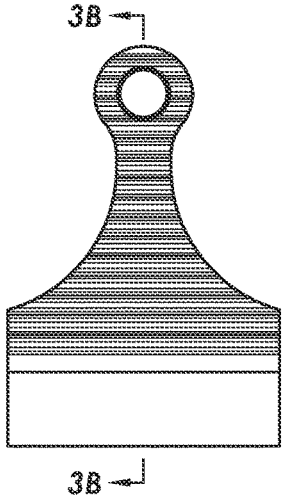
FIG. 3A is the first end view of the gunsight shown in FIG. 1A.
Figure 3B:
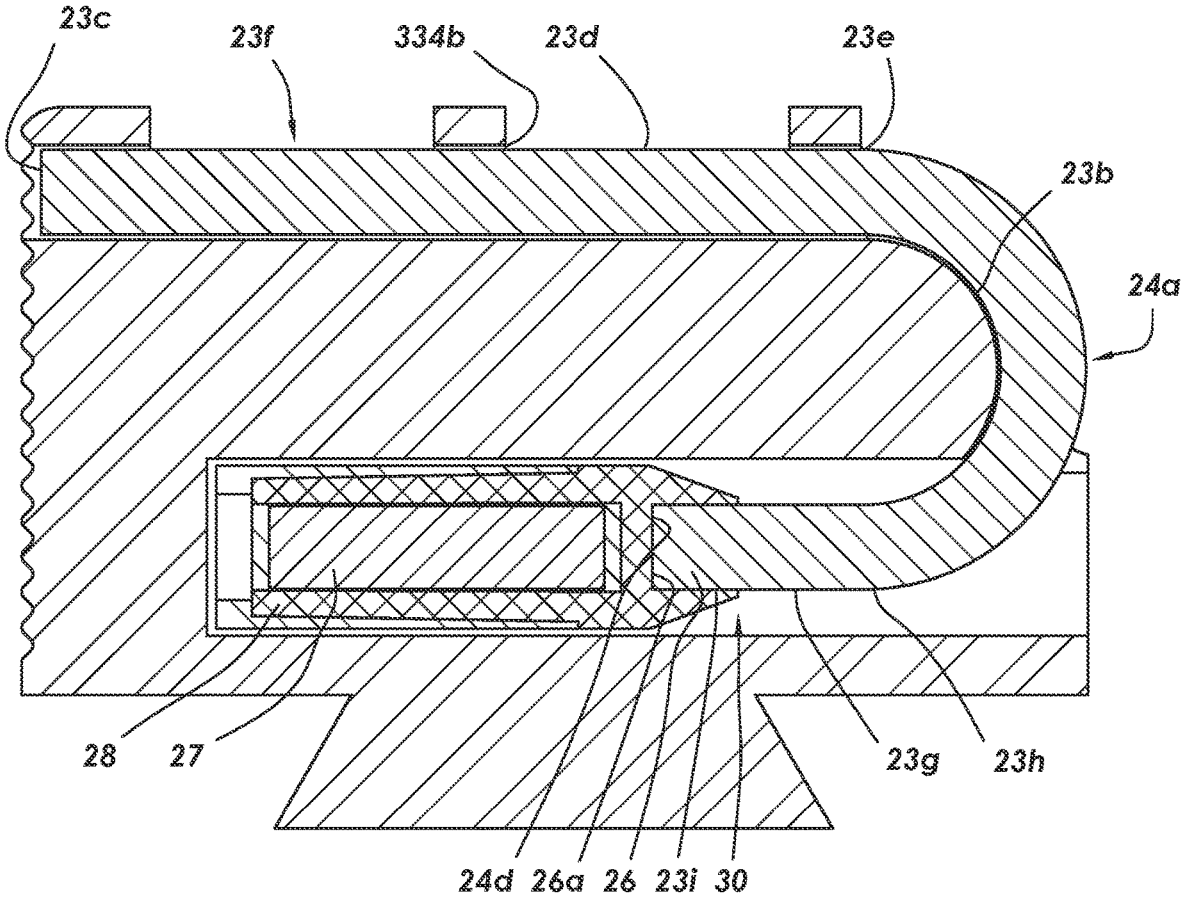
FIG. 3B is a sectional view of the gunsight shown in FIG. 1 taken along the view lines of FIG. 3A; the view along a plane passing through a length of the elongate light collector, and a length of the support, each length extending along a longitudinal axis of the support.
Figure 5:
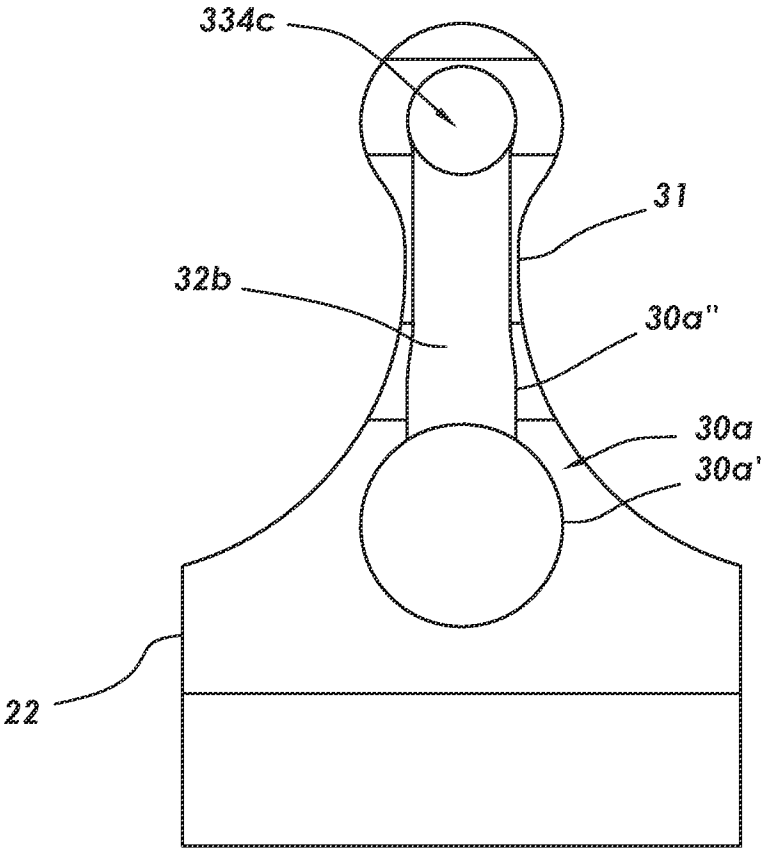
FIG. 5 is a second end view of the support shown in FIG. 4 opposite the first end view.
Figure 4:
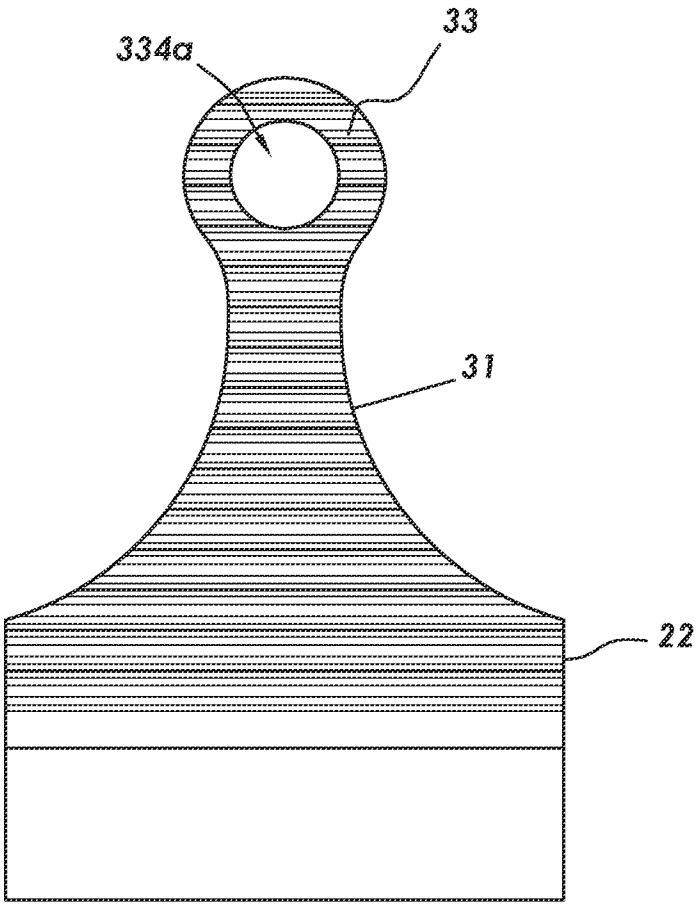
FIG. 4 is a first end view of the support shown in FIG. 1.
Figure 7:
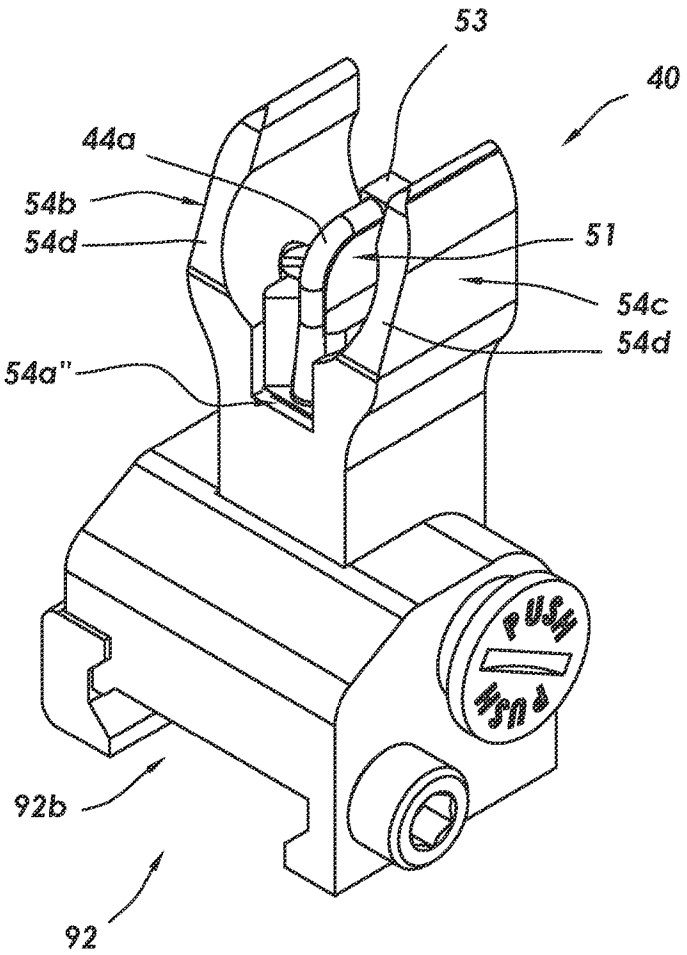
FIG. 7 is an isometric view of an alternative embodiment of a front gun sight having a support coupled to a light collector embodying features of the present invention.
Figure 6:
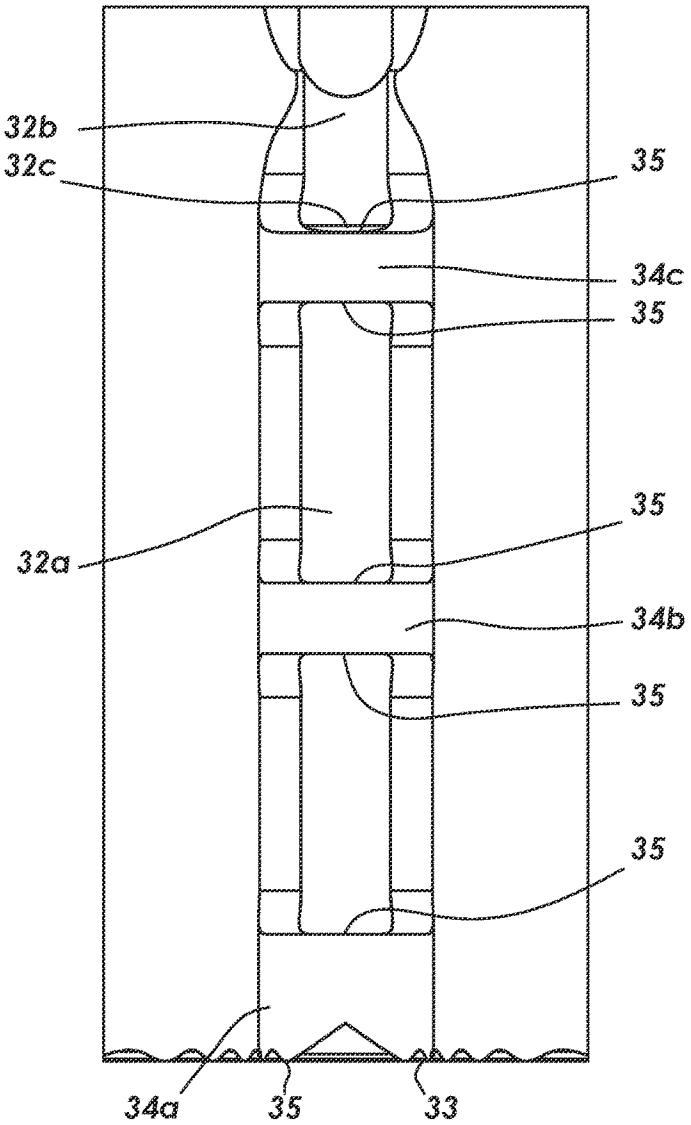
FIG. 6 is a top view of the support shown in FIG. 4.
Figure 8:
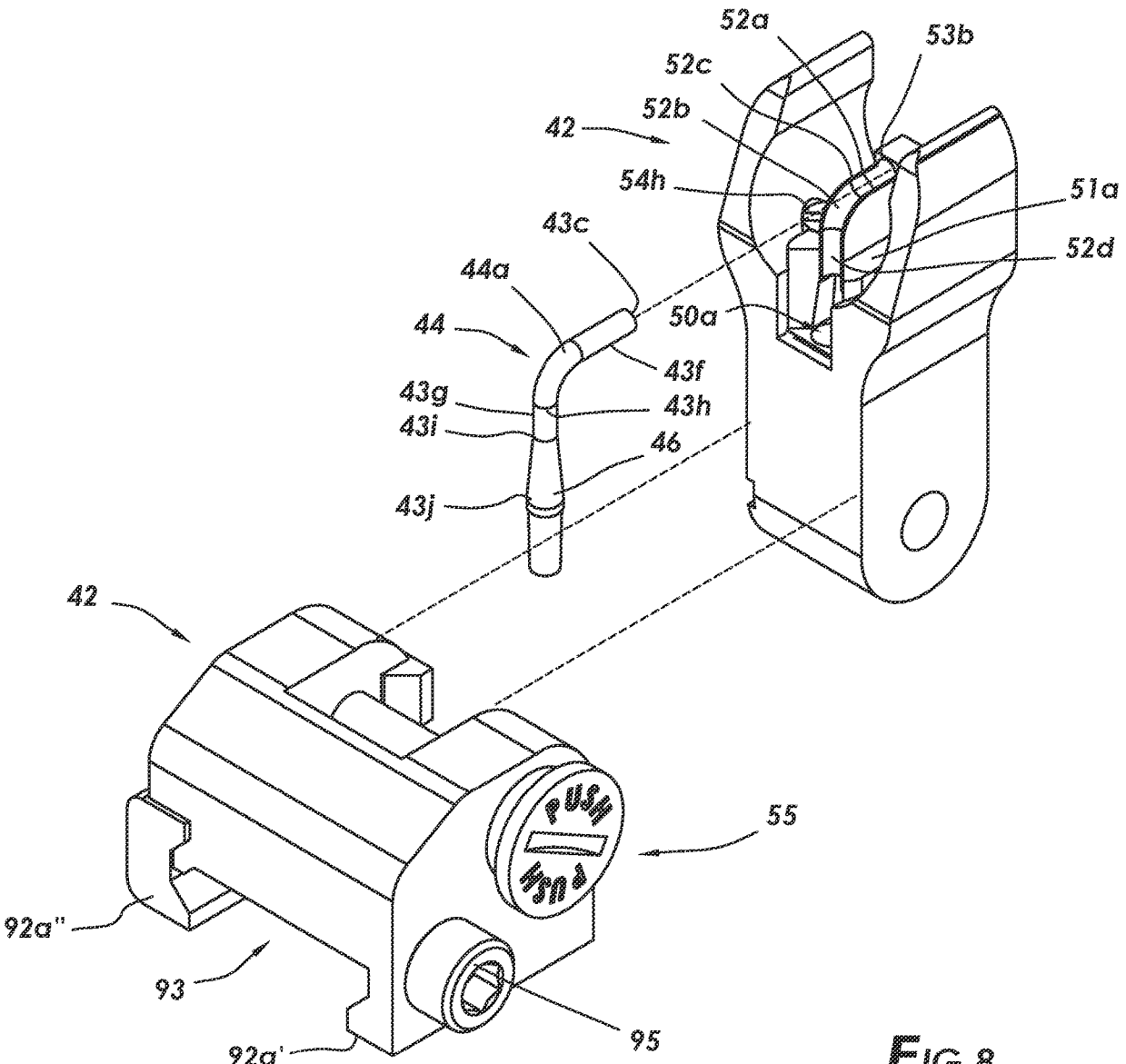
FIG. 8 is the isometric view of the gunsight shown in FIG. 7 wherein the light collector is exploded off the carrier; and the carrier housing is exploded of the base.

FIGS. 1 through 16 depict various gun sights embodying features of the present invention. FIGS. 1A, 1B, 2, 3 on the one hand and 7, 8, 9A, 9B on the other hand each depict alternative embodiments of front gunsights (20, 40). Each front gun sight (20, 40) includes a support (22, 42) each of which carries an elongate light collector (24, 44). The light collector (24, 44) of each sight collects and directs ambient light to illuminate the illuminating surface (25, 45) of the light collector (20, 40). Each illuminating surface (25, 45) when illuminated forms as a brilliant surface and can have the appearance of a bright mark such as a dot even when the sight is used in an environment having bright ambient light. Each light collector (24, 44) includes a terminal (26, 46) proximate a light generating source (27, 47), such as tritium. An alternative light generating source can be an LED. Each terminal (26, 46) includes a surface (26*a*, 46*a*) which directs the light generated by its light generating source (27, 47) and directs the light from its terminal surface (26*a*, 46*a*) downstream along its elongate light collector (24, 44). Each light collector (24, 44) directs the light to its illuminating surface (25, 45). The directed light, generated by each light generating source (27, 47), in low ambient light environments or in the dark, illuminates its illuminating surface (25, 45) to appear as a bright mark such as a dot. Each elongate collector (24, 44) extends a length from its illuminating surface (25, 45) to its terminal surface (26, 46). Each illuminating surface (25, 45) when illuminated to appear as a dot provides a sighting reference point. The firearm user can employ the reference point to reference a target relative to the gun barrel.

FIGS. 13A,14A, 15B, 15C, 15D show a rear gun sight (60). The sight employs a pair of elongate light collectors (62*a*, 62*b*) carried by a support (61). Each elongate collector (62*a*, 62*b*) collects and directs light to its respective illuminating surface (64*a*, 64*b*). Each illuminating surface (64*a*, 64*b*) when illuminated demarks spaced apart surfaces (66*a*, 66*b*) delimiting an entry (67) into the open space 69 of a sighting notch. Each elongate member (62, 63) has a terminal (70*a*, 70*b*) proximate a light generating source (71). The light generating source is shared by each elongate member (62*a*, 62*b*). The light generating (71) source resides proximate each collector's terminal (70*a*, 70*b*). Each terminal has a terminal surface (72*a*, 72*b*). The illuminating surfaces (64*a*, 64*b*), when illuminated by collected ambient light or the collected generated light, appear as dots to reference the rear gunsight's notch (66*a*, 66*b*) with the front sight's reference point. The firearm user can employ the reference points to reference a target relative to the gun barrel.

Each elongate light collector (24, 44, 62*a*, 62*b*) includes a curved section (24*a*, 44*a*, 622*a*, 622*b*) along the length of the collector extending from each collector's illuminating surface (25, 45, 64*a*, 64*b*) to the collector's terminal surface (26, 46, 72*a*, 72*b*). As explained more fully below, the curved section (24*a*, 44*a*, 622*a*, 622*b*) of each elongate light collector resides on and extends along a curved surface (23*b*, 52*b*, 63*a*, 63*b*) of its respective support.

Now referring to the elongate light collectors in more detail, each light collector (24, 44 62*a*, 62*b*,) extends its entire length from a first end (23*c*, 43*c*, 623*a*, 623*b*) to a second end (23*d*, 43*d*, 624*a*, 624*b*). The direction from the first end to the second end along the length of the elongate light collector can be considered an upstream direction. The direction from the second end to the first end along the length of the light collector can be considered a downstream direction. Each first end (23*c*, 43*c* ,623*a*, 623*b*) can have its collectors illuminating surface (25, 45, 64*a*, 64*b*). Along the length of each light collector (24, 44 64*a*, 64*b*), starting from the first end going upstream to a first point (23*e*, 43*e*, 626*a*, 625*b*) each light collector extends along a longitudinal axis in a linear fashion. Each linear extension (23*f*, 43*f*, 626*a*, 626*b*) can be considered a first section (23*f*, 43*f*, 626*a*, 626*b*) of each elongate light collector (24, 44 62*a*, 62*b*). The illuminating surface (25, 64*a*, 64*b*) of each light collector (24, 44 62*a*, 62*b*,) along the first section (23*f*, 43*f*, 626*a*, 626*b*), and preferably at the first end (23*c*, 43*c* , 623*a*, 623*b*). Along the length, upstream of its first section (23*f*, 43*f*, 626*a*, 626*b*), each elongate light collector includes its curved section (24*a*, 44*a*, 622*a*, 622*b*). Each curved section (24*a*, 44*a*, 622*a*, 622*b*) can form a "U" shape and have a radius of curvature. Each curved section (24*a*, 44*a*, 622*a*, 622*b*) can extend upstream from the first point (23*e*, 43*e*, 626*a*, 625*b*) to a third point (23*h*, 43*h*, 628, 628*b*). Each curved section (24*a*, 44*a*, 622*a*, 622*b*) can be considered a second section (24*a*, 44*a*, 622*a*, 622*b*) of its elongate collector (24, 44, 62*a*, 62*b*).

Along the length of each elongate collector (24, 44, 62*a*, 62*b*), upstream of each curved section (24*a*, 44*a*, 622*a*, 622*b*) can reside a further third section (23*g*, 43*g*, 627*a*, 627*b*) of each light collector (24, 44, 62*a*, 62*b*). Each third section (23*g*, 43*g*, 627*a*, 627), upstream of its second section (24*a*, 44*a*, 622*a*, 622*b*), can extend along the longitudinal axis of its third section (23*g*, 43*g*, 627*a*, 627*b*), in a linear fashion. The third section (23, 43*g*, 627*a*, 627*b*) can start at the third point (23*h*, 43*h*, 628*a*, 628*b*) and extends upstream to a fourth point (23*i*, 43*i*, 629*a*, 629*b*). Each fourth point (23*i*, 43*i*, 629*a*, 629*b*) along its light collector can reside at its light collector's terminal (26, 46, 70*a*, 70*b*) and the terminal surface (26*a*, 46*a*, 72*a*, 72*b*). The light generating source (27, 47, 71) resides proximate each collector's terminal (26, 46, 70*a*, 70*b*) and terminal surface (26*a*, 46*a*, 72*a*, 72*b*). The third section (43*g*) can be orthogonal to the first section (43*f*) as shown in front gunsight (40). The third section (23*g*, 627*a*, 627*b*) can be parallel to its first section (23*f*, 626*a*, 626*b*) or at an angle between 10 and 89 degrees with its first section (23*f*, 626*a*, 626*b*). Each curved section (23*b*, 43*b*, 63*a*, 63*b*) of its light collector interconnects the first (23*f*, 43*f*, 626*a*, 626*b*) and third section (23*g*, 43*g*, 627*a*, 627*b*) of its light collector. The third section (627*a*, 627*b*) of each light collector (62*a*, 62*b*) can be coextensive with the terminal (70*a*, 70*b*). Respecting the light collector's (62*a*, 62*b*) in FIG. 13A they can share a light generating source (71) or can have their own separate light generating source.

Figure 9A:
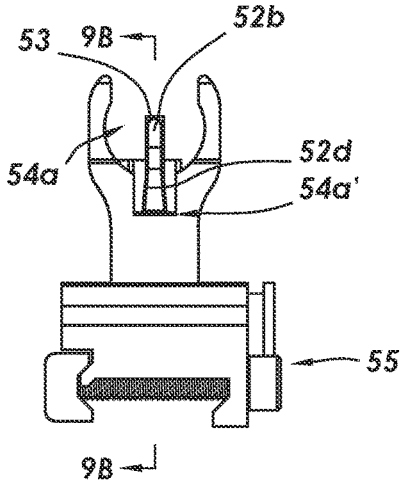
FIG. 9A is a first end view of the gunsight shown in FIG. 7.
Figure 9B:
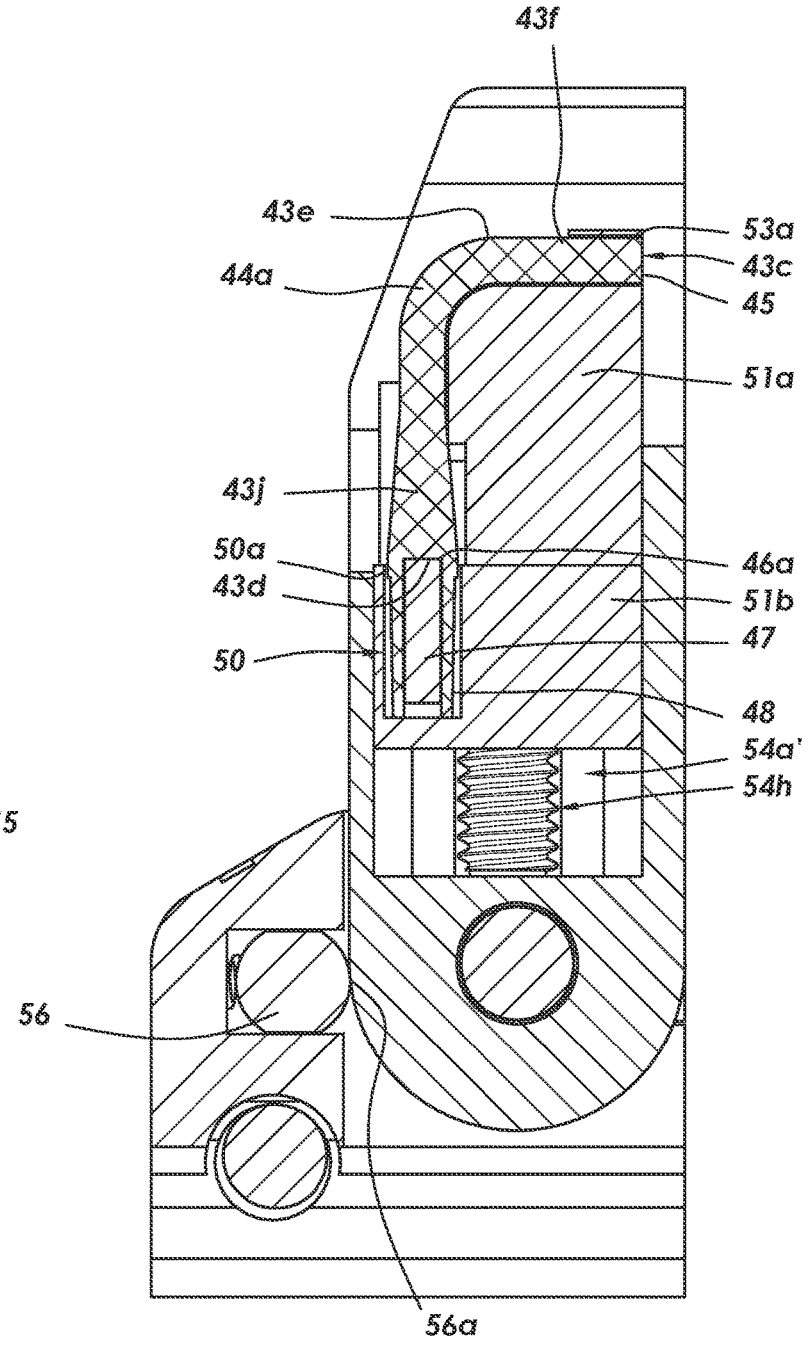
FIG. 9B is a sectional view of the gunsight shown in FIG. 7 taken along the view lines in FIG. 9A; the section taken along a plane passing through the length of the light collector and through an axis of the support wherein the axis extends along the width of the support.
Figure 11:
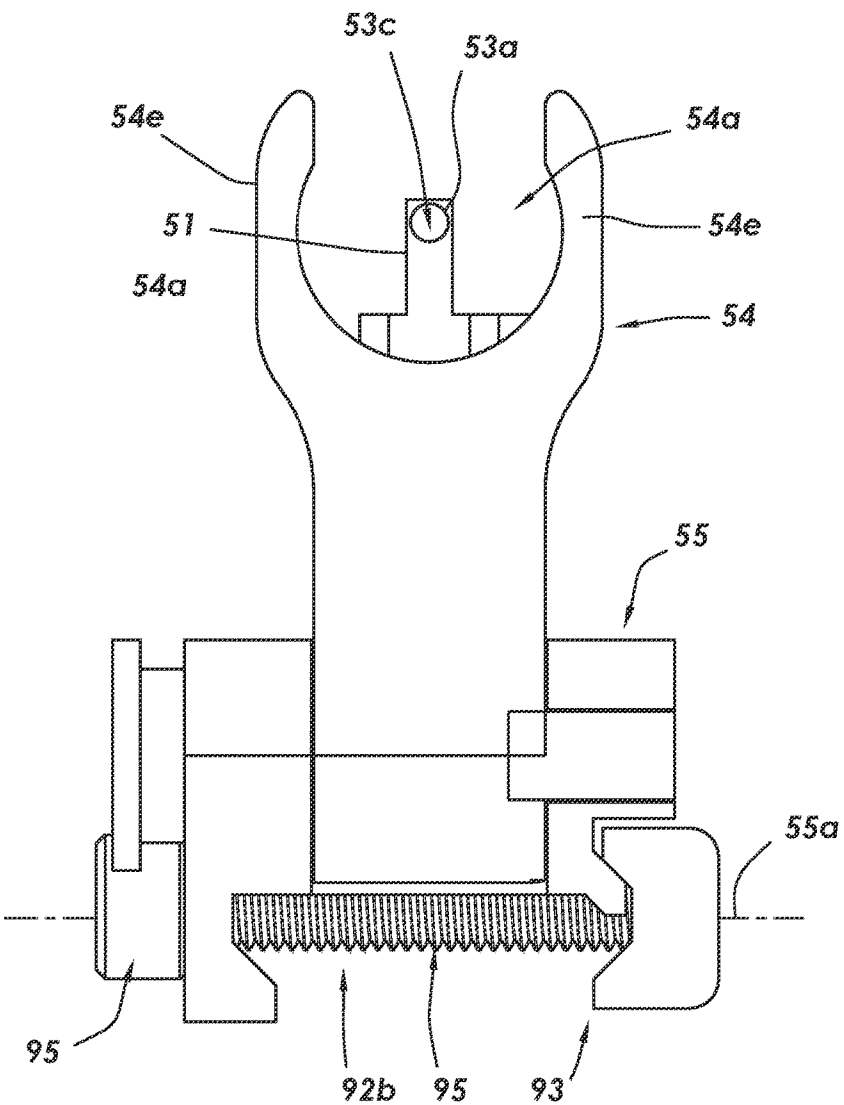
FIG. 11 is a second end view of the support shown in FIG. 10 opposite the first end view.
Figure 10:
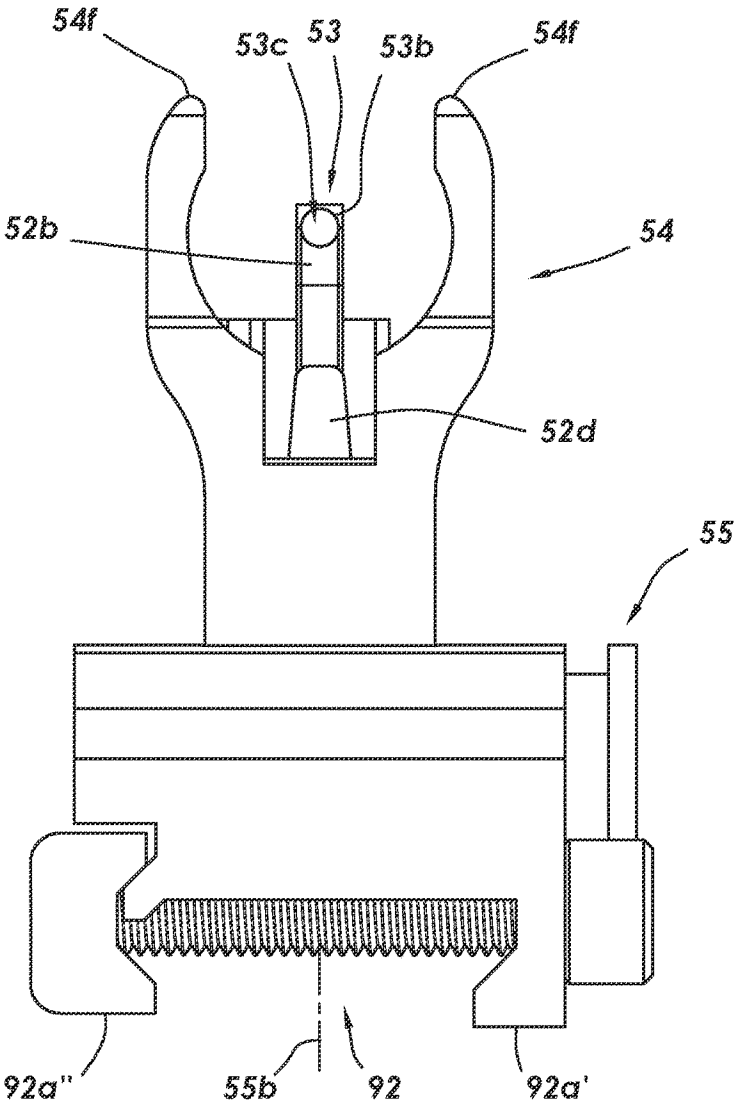
FIG. 10 is a first end view of the support shown in FIG. 7.
Figure 12:
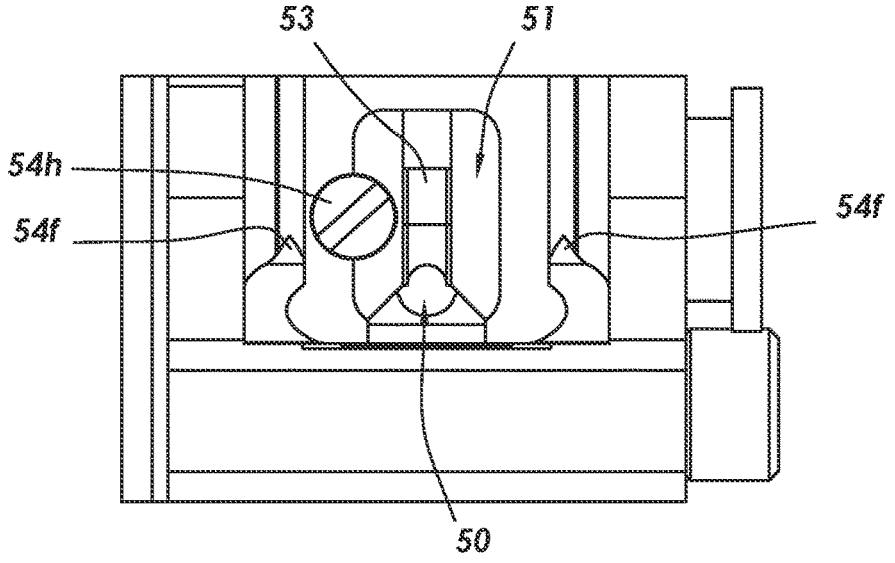
FIG. 12 is a top view of the support shown in FIG. 10.
Figure 13A:
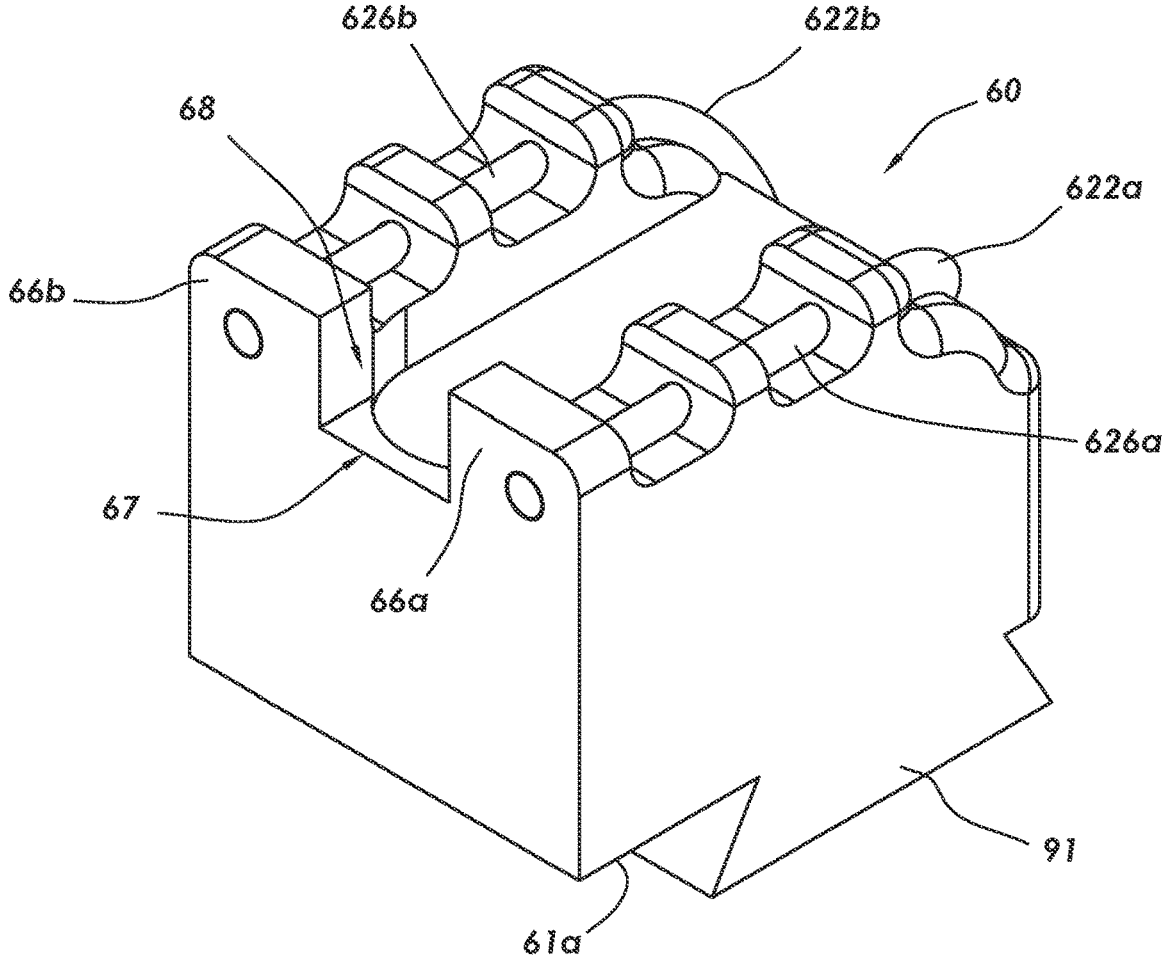
FIG. 13A is an isometric view of a rear gunsight having a support coupled to a pair of elongate light collectors embodying features of the present invention.
Figure 13B:
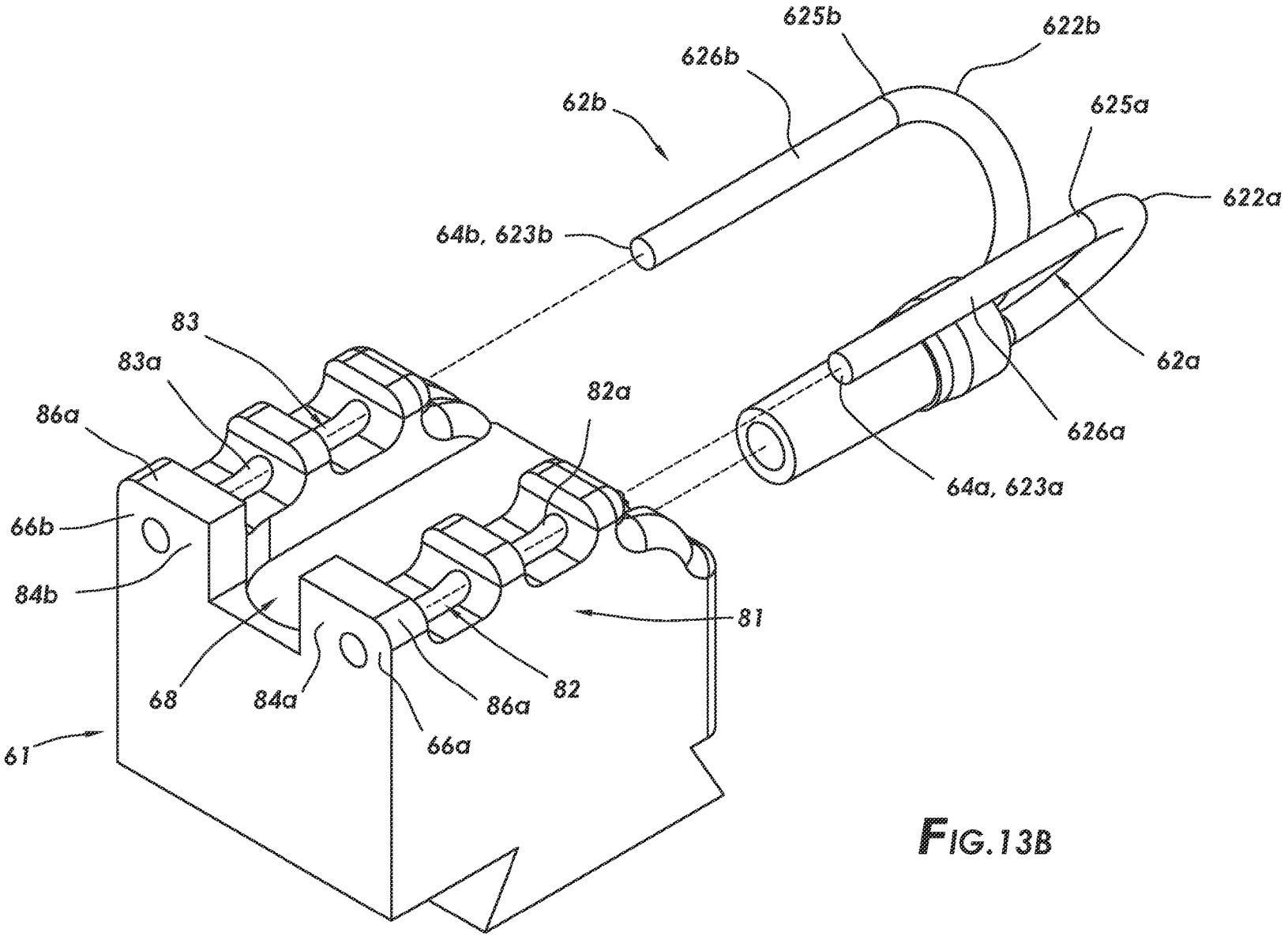
FIG. 13B is the isometric view of the gunsight shown in FIG. 13A with the light collectors exploded off the support.
Figure 14A:
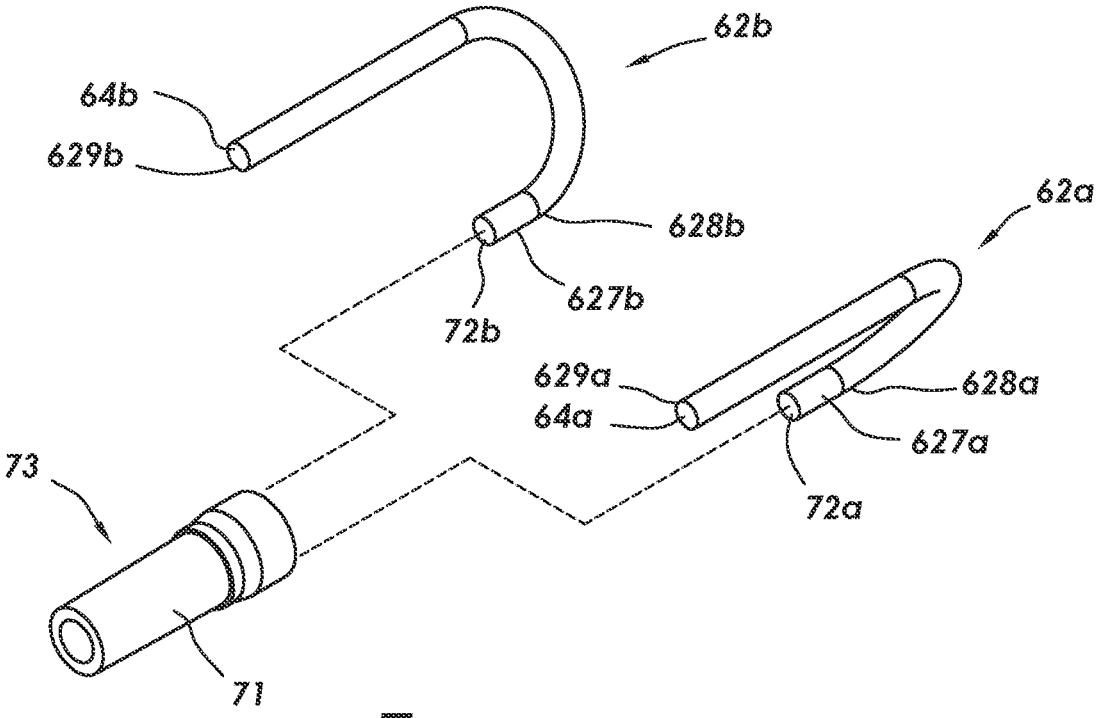
FIG. 14A is an exploded isometric view of the light collectors and light source housing shown in FIG. 13B; the view looking into the first ends of the light collectors.
Figure 14B:
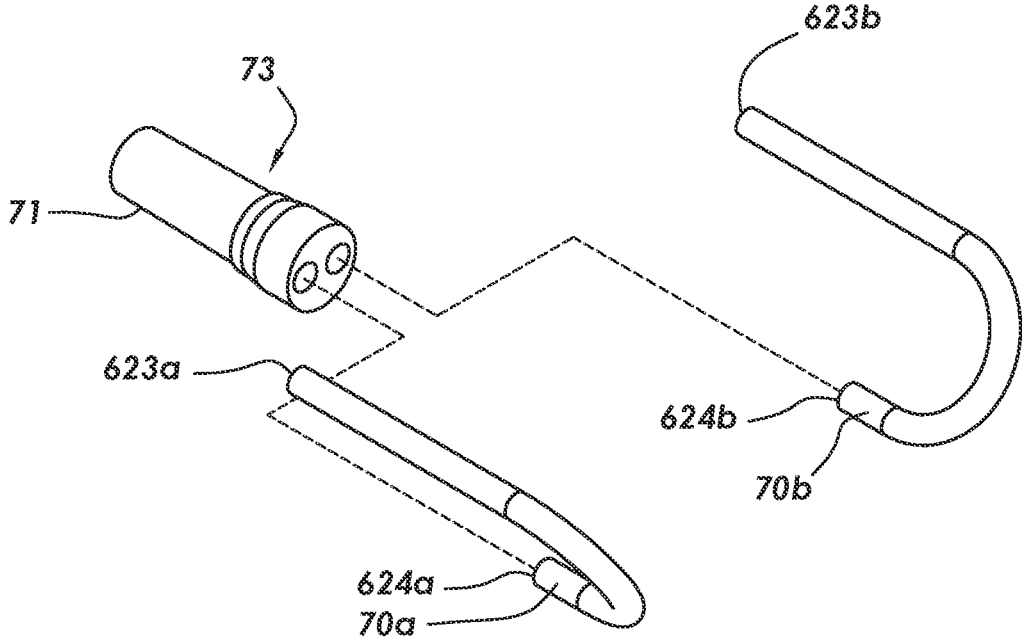
FIG. 14B is an exploded isometric view of the light collectors and light source housing shown in FIG. 13B; the view looking into the curved sections of the light collectors.
Figure 15A:
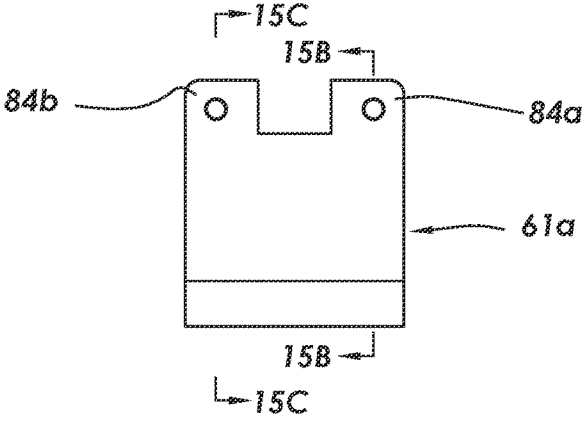
FIG. 15A is a first end view of the gunsight shown in FIG. 13A.
Figure 15C:
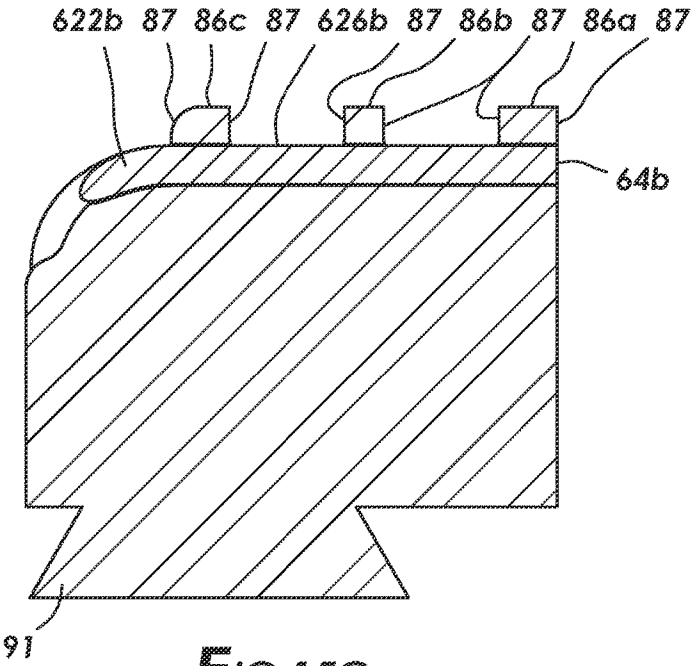
FIG. 15C is a second sectional view of the gunsight shown in FIG. 13A wherein the section is taken along view lines 15C of FIG. 15A.
Figure 15B:
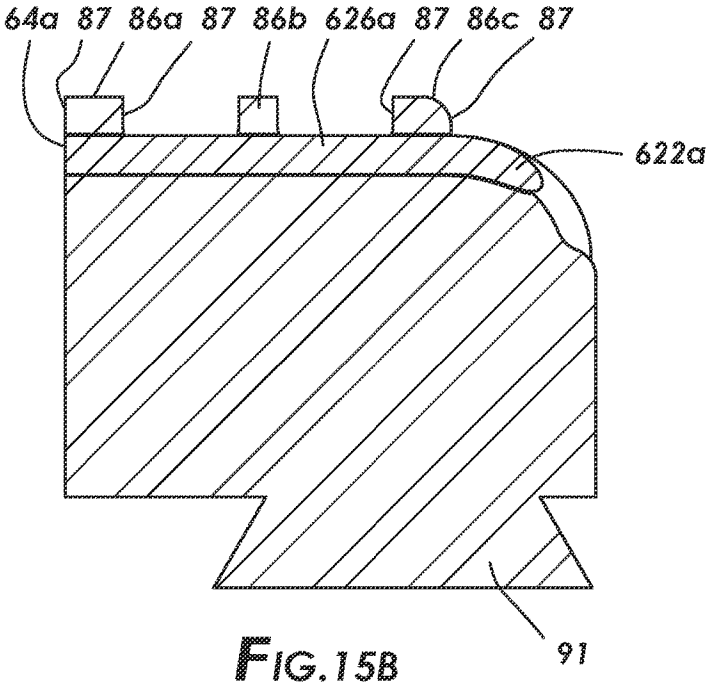
FIG. 15B is a first sectional view of the gunsight shown in FIG. 13A wherein the section is taken along view lines 15B of FIG. 15A.
Figure 15D:
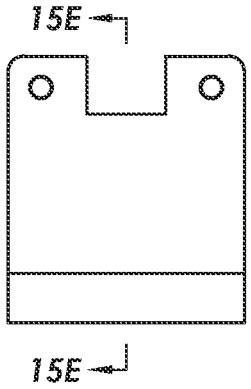
FIG. 15D is the first end view of the gunsight shown in FIG. 13A.
Figure 15E:
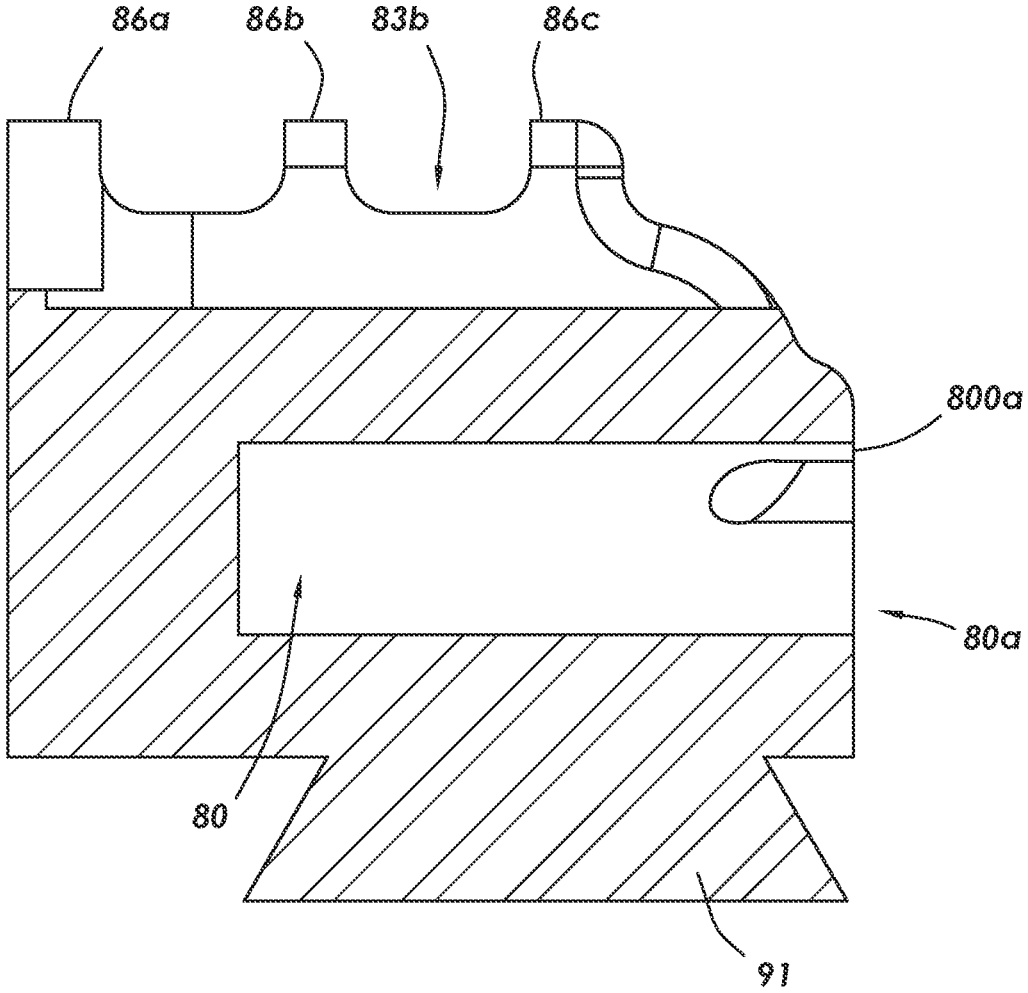
FIG. 15E is a third sectional view of view of the gunsight shown in FIG. 13A; the section taken along view lines 15E of FIG. 15D.
Figure 16C:
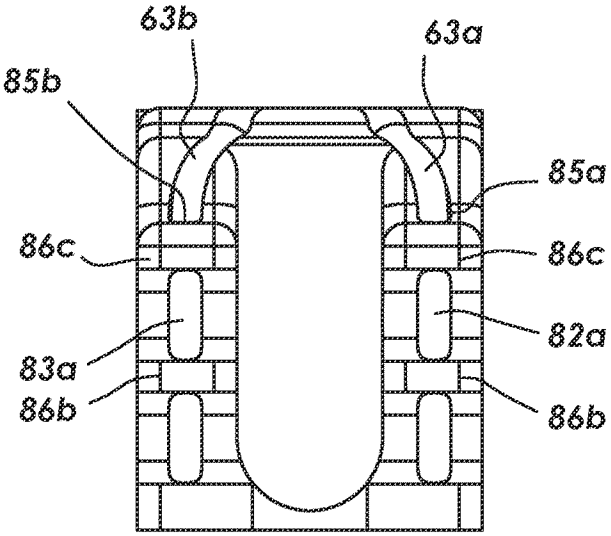
FIG. 16C is a top view of the support shown in FIG. 13A.
Figure 16B:
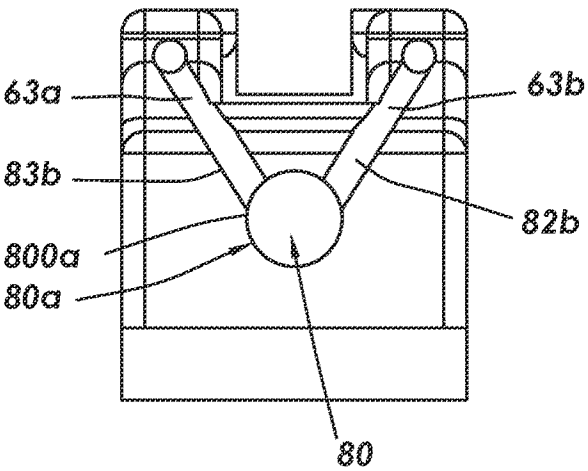
FIG. 16B is a second end view of the support shown in FIG. 13A opposite the first end view.
Figure 16A:
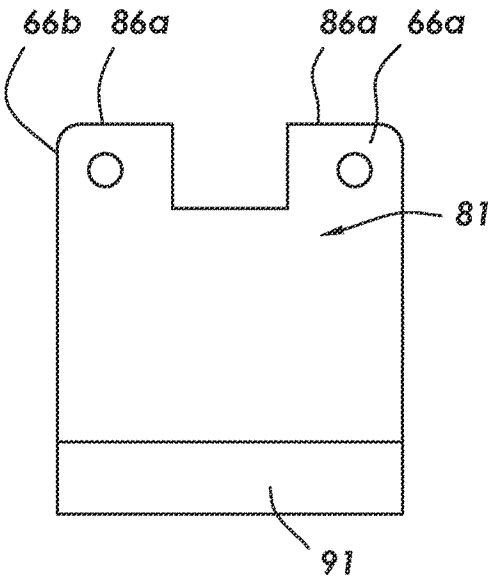
FIG. 16A is a first end view of the support shown in FIG. 13A.

Respecting the elongate collector (44) in FIG. 9A, along its length, going upstream, it can include a fourth section (43*j*). The fourth section (43*j*) at its most upstream end can be at the terminal (46) and include the terminal surface (46*a*). An exterior surface of the fourth section can taper radially inward towards the fourth sections longitudinal axis along the longitudinal length of the fourth section (43*j*) in the downstream direction. The tapering exterior surface of the fourth section can delimit a frustoconical section (43*j*). The fourth section's (43*j*) longitudinal axis extends orthogonal to the first section (43*f*). The fourth section (43*j*) forms the terminal (46) of the light collector with the terminal surface (46*a*). The light generating source (47) resides approximate the collector's terminal (46).

Light generating source housings (28, 48, 73) can extend in a direction away from its respective terminal (26, 46, 70*a*, 70*b*). Each housing (28, 48, 73) can reside proximate its respective terminal (26, 46, 70*a*, 70*b*) and adjacent thereto. Each housing (28, 48, 73) can be connected to a respective light collector (24, 44, 62*a*, 62*b*). The connection can be fixed. The connection can be at the fourth section (43*j*) or third section (23*g*, 43*g*, 627*a*, 627*b*) or terminal (26, 46, 70*a*, 70*b*) or curved section (23*b*, 43*b*, 622*a*, 622*b*). The housings (28, 48, 73) and light collectors (24, 44, 62*a*, 62*b*) can form a seamless monobloc construction. Each light generating source (27, 47, 71) such as tritium can reside in its respective housing (28, 48, 73). Respecting the rear gunsight (60), each elongate collector (62*a*, 62*b*) can share a light generating housing (73) as shown or have their own light generating housing disconnected from the other collector's housing. The light generating source housings (28, 48, 73) and light sources (27, 47, 71) can reside in a respective hollow (30, 50, 80) delimited by an internal surface of its support (22, 42, 61).

Each elongate light collector (24, 44, 62*a*, 62*b*) can be made from flexible plastic and can be solid. The collector may be hollow or include hollow portions. The construction of each elongate light collector is adapted to direct ambient light to the elongate collector's illuminating surface (25, 45, 64*a*, 64*b*) and illuminate the illuminating surface. The construction further adapted to capture generated light from the light source (28, 48, 71) at the terminal surface (26*a*, 46*a*, 72*a*, 72*b*) and direct the captured light to the illuminating surface (25, 45, 64*a*, 64*b*).

In more detail the support (22) of the front gunsight (20) is a monobloc construction. The front gunsight (20) support (22) includes a carrier (31) that includes a carrier surface first section (32*a*) and a carrier surface second section (32*b*). The surface first section (32*a*) forms an elongated groove. The surface first section (32*a*) extends between an end surface (33) of the carrier (31) and a first point (32*c*) along the carrier (31). The first section (32*a*) resides at the end surface (33).

The surface first section (32*a*) includes a longitudinal axis. The length of the first section (32*a*) extends linearly along the direction of the longitudinal axis. The surface second section (32*b*) also forms an elongated groove which extends between an entry (30*a*) into the hollow (30) delimited by an internal surface of the support (22) and the surface first section (32*a*). The surface second section (32*b*) extends in angled relation to the surface first section (32*a*). The surface second section (32*b*) forms a curve. The curve includes a radius of curvature. The second section (32*a*) can further extend into the hollow (30) through the entry and delimit the hollow (30). The surface first section (32*a*) and surface second section (32*b*) are continuous with each other. The carrier (31) includes a first (34*a*), a second (34*b*) and a third (34*c*) enclosure. Each enclosure includes an internal surface which delimits an open space (334*a*, 334*b*, 334*c*). Each open space having a first open access and an opposite second open access delimited by opposite end surfaces (35) of each enclosure. The end surface of the support (33) can include an end surface of the first enclosure (34*a*). The surface first section (32*a*) forms portions of the internal surface of each enclosure. The groove formed by the surface first section (32*a*) forms portions of the internal surface of each enclosure (34*a*, 34*b*, 34*c*).

In more detail the support (61) of the rear gunsight (60) is a monobloc construction. The rear gunsight support (61) also includes a carrier. The carrier (81) includes a carrier first surface (82) and a carrier second surface (83). The first (82) and second (83) surface each include a first section (82*a*, 83*a*) and a second (82*b*, 83*b*) section. Each first section (82*a*, 83*a*) extends between a respective end surface (66*a*, 66*b*) and a respective first point (85*a*, 85*b*) of the support. Each first section (82*a*, 83*a*) resides at its respective end surface (66*a*, 66*b*). The respective end surfaces (66*a*, 66*b*), spaced apart, delimit an entry (67) into a sighting notch open space (69). Each first section (82*a*, 83*a*) forms an elongated groove. The first sections (82*a*, 83*a*) extend side by side with each other from their respective first end surface (66*a*, 66*b*)

to their respective first point (85*a*, 85*b*). The first (82) and second (83) surface's second sections (82*b*, 83*b*) each form an elongated groove. The surface second sections (82*b*, 83*b*) each extends in angled relation to each surface's first sections (82*a*, 83*a*). Each surface second section (82*b*, 83*b*) forms a curve. Each curve includes a radius of curvature. Each surface first section (82*a*, 83*a*) is continuous with its surface's second section (82*b*, 83*b*). Each second section (82*b*, 83*b*) extends between an entry (80*a*) into the hollow (80) delimited by an internal surface of the support (61). Each second section (82*b*, 83*b*) can further extend into the hollow (80) through the entry (80*a*) and delimit the hollow (80). Although each second section shares the same entry and hollow, they could have their own entry and hollow. Each entry can be delimited by the support without opening into the other entry delimited by the support. Each entry can be delimited by the support from the other entry. Although each second section shares the same entry and hollow, they could have their own entry and hollow. Likewise, each hollow can be delimited by the support without opening into the other hollow delimited by the support. Each hollow can be delimited by the support from the other entry. The carrier includes a pair of first (86*a*), a pair of second (86*b*) and a pair of third (86*c*) enclosures. Each enclosure includes an internal surface which delimits an open space (866*a*, 866*b*, 866*c*) of its enclosure. Each open space having a first open access and an opposite second open access delimited by opposite end surfaces (87) of each enclosure. The end surfaces (85) of the support can include an end surface (66*a*, 66*b*) of each of the first enclosures. The first section (82*a*) of the first surface (82) forms portions of the internal surface of one of each pair of each enclosure (86*a*, 86*b*, 86*c*). The groove formed by the first section (82*a*) forms portions of the internal surface of one of each pair of each enclosure (86*a*, 86*b*, 86*c*). The first section (83*a*) of the second surface (83*b*) forms portions of the internal surface of the other one of each pair of each enclosure (86*a*, 86*b*, 86*c*). The groove formed by the first section (83*a*) of the second surface (83) forms portions of the internal surface of the other one of each pair of each enclosure (86*a*, 86*b*, 86*c*). The pair of first enclosures (86*a*) delimit the open space (69) of the sighting notch. Each end surface (66*a*, 66*b*) delimiting the first open access of each first enclosure (86*a*) are spaced apart from each other to form the entry (67) into the open space (69) of the notch.

Now referring to front gunsight (20), its support (22) and elongate light collector (24) couple with each other. In the coupled relationship, the elongate collector's first section (23*f*) rests on and extends along the surface first section (32*a*). It resides in the groove. The illuminating surface (25) at the first section (23*f*) faces in the same direction as end surface (33) of the first enclosure. Its proximate the first open access (334*a*′) of the first enclosure. The elongate collector first section (23*f*) extends through the second (34*b*) and third (34*c*) enclosures. The elongate collector's second section (23*b*) rests on and extends along the surface second section (32*b*). It resides in the second section (32*b*) groove. The second section (32*b*) extends through the entry (30*a*) into hollow (30) and into hollow. The third section (23*g*) is in the hollow (30). The light generating housing (28) is in the hollow and connected to the third section (23*g*). The connection in the hollow (30). The light generating source 27 resides in the hollow (30) and inside the housing (28). The entry (30a) into the hollow (30) includes a 360 degree perimeter (30*a*′).

Now referring to rear gunsight (60), its support (61) and elongated light collectors (62*a*, 62*b*) couple with each other. In the coupled relationship, each elongate collector's first section (626*a*, 626*b*) rests on and extends along its respective support first section surface (82*a*, 83*a*). Each elongate first section (626*a*, 626*b*) resides in the groove of its respective support first section surface (82*a*, 83*a*). The illuminating surface (64*a*, 64*b*) at each light collector first section (626*a*, 626*b*) faces in the same direction as the end surface (64*a*, 64*b*) of its respective first enclosure (86*a*). Each illuminating surface (64*a*, 64*b*) proximate the first access of its respective first enclosure (86*a*). The illuminating surfaces (64*a*, 64*b*) when illuminated demark spaced apart surfaces delimiting an entry (67) into the open space (69) of the sighting notch. Each elongate collector first section (82*a*, 83*a*) extends through its respective second (86*b*) and third (86*c*) enclosures. Each elongate collector's second section (622*a*, 622*b*) rests on and extends along its respective second section surface (82*b*, 83*b*). It resides in the second section (82*b*, 83*b*) groove. The second section (622*a*, 622*b*) of each elongate light collector (62*a*, 62*b*) extends through the entry (80*a*) and into hollow (80). The third section is in the hollow (80). The light generating housing (73) is in the hollow (80) and connected to each third section (627*a*, 627*b*). The connection in the hollow (80). The light emitting source (71) resides in the hollow (80). The entry (80*a*) a 360 degree perimeter (800*a*). The perimeter includes a radius of curvature which corresponds to about more than 50% of its length.

The construction of front gunsight (40) provides for adjusting a portion (51) of the support (42) relative to the gun. It also provides for adjusting the position of the light collector (44) relative to the gun and portions of the support (42). The support (42) includes a carrier (51) including a holder (51*a*) and a carrier base (51*b*). The holder includes a surface first section (52*a*). The surface first section (52*a*) forms a groove. The surface first section includes a longitudinal axis. The length of the first section (52*a*) extends linearly along the direction of the longitudinal axis. The surface first section (52*a*) extends between an end surface (53*a*) of the holder and a first point (52*c*) along the holder (51*a*). The first section resides at the end surface of the holder. The holder (51*a*) includes a surface second section (52*b*). The surface second section (52*b*) forms an elongated groove. The surface second section (52*b*) extends between the first section (52*a*) and a third surface second (52*d*). The surface second section (52*b*) extends in angled relation to the surface first section (52*a*) and surface third section (52*d*). The surface second section (52*b*) forms a curve. The curve includes a radius of curvature. The surface third section extends between the second section (52*b*) and an entry (50*a*) into a hollow (50) delimited by surface of the carrier base (51*b*). The surface third section (52*d*) includes a longitudinal axis. The length of the third section extends linearly along the direction of the longitudinal axis. The third section (52*d*) longitudinal axis extends perpendicular to the first section (52*a*) longitudinal axis. The holder (51*a*) includes an enclosure (53). The enclosure includes an interior surface delimiting an open space (53*c*). The open space having a first open access and an opposite second open access delimited by opposite end surfaces (53*a*, 53*b*) of the enclosure. The end surface (53*a*) of the holder can be an end surface (53*a*) of the enclosure.

With the elongate collector (44) in the coupled relationship, the elongate collector's first section (43*f*) rests on and extends along the surface first section (52*a*). It resides in the groove. The illuminating surface (45) at the first section (52*a*) faces in the same direction as end surface (53*a*) of the enclosure (53). Its proximate the end surface (53*a*) of enclosure (53). The elongate collector's second section (43*b*) rests on and extends along the surface second section (52*b*). It resides in the surface second section (52*b*) groove. The elongate collector's third (43*g*) and fourth section (43*j*) rest on and extend along the holder's surface third section (52*d*). The elongate collector's third section (43*g*) resides in the groove. The fourth section (43*j*) resides in a complimentary recess formed by the surface third section (52*d*). The elongate collector terminal surface (46*a*) resides proximate the entry (50*a*) to the hollow in the carrier base. The light generating source housing (48) resides in the hollow (50) and connects to the elongate collector (44) at the fourth section (43*j*) and terminal (46).

The support (42) includes a carrier housing (54) pivotably coupled to a support base (55). The base (55) has a first axis (55*a*) extending perpendicular to a base second axis (55*b*). The first axis (55*a*) extends along a length of the base. The second axis (55*b*) extends along a width of the base. The carrier housing (54) delimits an open space (54*a*). The carrier (51) resides in the open space (54*a*). The housing open space (54*a*) includes a hollow (54*a'*) delimited by internal surface of the housing (54) in which the carrier base (51*b*) resides. The housing (54) includes a first (54*b*) and second (54*c*) wall extending in a direction of a longitudinal axis (54*d*) of the housing. The first (54*b*) and second (54*c*) wall extend away from the entry (54*a''*) to the housing hollow (54*a'*). The walls spaced apart a length along the direction of the base first longitudinal axis (55*a*). The spaced apart walls delimit an open part of the open space (54*a*). A first pair of end surfaces (54*d*) delimit a first access to the one space (54*a*) a pair of second end surfaces (54*e*), opposite the first pair (54*d*), delimit a second access into the space (54*a*); a third pair of end surfaces (54*f*) delimit a third access to the space. One of the third end surfaces (54*f*) interconnects one of said pair of first end surfaces (54*d*) with one of said pair of second end surfaces (54*f*). The other of said third end surfaces (54*f*) interconnects the other of first end surface (54*d*) to the other of the second end surface (54*e*). The carrier (51) with the elongate collector (44) resides in the space (54*a*). The illuminating surface (45) resides proximate the second pair of end surfaces (54*e*) and distal the first pair of end surfaces (54*d*). The housing (54) has a longitudinal axis. The longitudinal axis extends between third pair end surfaces (54*f*), through the space (54*a*), and hollow (54*a''*). The housing extends a length along the longitudinal axis.

In operation a user may pivot the housing (54) holding the carrier (51) and elongate light collector (44) from an upright orientation to a lowered orientation and vice versa. In the lowered orientation, the collector first section (43*f*) extends in a direction parallel to the base second axis (55*b*). In the upright orientation, the light collector first section extends perpendicular to the base second axis (55*b*). During pivot adjustment of the housing (54) relative to base (55), the housing longitudinal axis rotates relative to and about base first axis (55*a*). A spring loaded insert (56) extends into a detent (56*a*) when the housing (54) resides in the upright orientation and lowered orientation. A threaded member (54*h*) such as a screw allows a user to adjust the carrier (51) coupled to the elongate collector (44) relative to the housing (54) along the length of the housing longitudinal axis.

The front and rear gunsight can include a connector (90, 91) to removably couple its support (22, 61) to a gun. Each connector (90, 91) can form a projection extending away from an end surface (22*a'*, 61*a'*) of its support (22, 61). The end surface can form an end of a base (22*a*, 61*a*) of its support (22, 61). The connector can form an insert which slidably engages into a delimited open area of a receiver (95). The receiver can include a guide, channel, and clamp. The receiver can reside at a front end portion of a gun barrel. The gunsight (20) when configured to engage the receiver at the front end portion of a gun barrel includes a connector (90) of a front gun sight (20). The connector (90) interconnects gunsight 20 to the gun (100). The receiver can also be formed at a top of the gun towards the guns rear. The gunsight (60) when configured to engage the receiver at the rear end portion of a top of a gun forms rear gunsight (60) having a connector (91) of a rear gun sight. The connector interconnects the support (61) to the gun.

A front and rear gunsight can use a connector configured as a receiver. Front gunsight (40) employs a connector (92) configured as a receiver (92). Rear gunsight (60) could also employ a connector configured like a receiver. The front gunsight (40) connector (92) can comprise a guide (92*a'*, 92*a''*), channel (92*b*), and clamp (93). In the present example the guide forms opposing elongated recessed areas which each receive a section of a connector mounted to the front of a gun barrel. Guide (92*a''*) is fixed relative to base (55). Guide (92*a'*) adjusts laterally relative to base (55) and fixed guide (92*a''*). It adjusts along the length of base first axis (55*a*). To close the expanse between guide (92*a'*) and guide (92*a''*), one adjusts set screw (95)

As can be easily understood from the foregoing, the basic concepts of the present invention may be embodied in a variety of ways. The invention involves numerous and varied embodiments of a sighting device having an elongate light collector and methods for making and using the same.

As such, the embodiments or elements of the invention disclosed by the description or shown in the figures accompanying this application are not intended to be limiting, but rather exemplary of the numerous and varied embodiments generically encompassed by the invention or equivalents encompassed with respect to any particular element thereof In addition, the specific description of a single embodiment or element of the invention may not explicitly describe all embodiments or elements possible; many alternatives are implicitly disclosed by the description and figures.

It should be understood that each element of an apparatus or each step of a method may be described by an apparatus term or method term. Such terms can be substituted where desired to make explicit the implicitly broad coverage to which this invention is entitled. As but one example, it should be understood that all steps of a method may be disclosed as an action, a means for taking that action, or as an element which causes that action. Similarly, each element of an apparatus may be disclosed as the physical element or the action which that physical element facilitates. As but one example, the disclosure of an "elongate light collector" should be understood to encompass disclosure of the act of "collecting light"—whether explicitly discussed or not—and, conversely, were there is a disclosure of the act of "illuminating", such a disclosure should be understood to encompass disclosure of an "illuminator" and even a "means for illuminating". Such alternative terms for each element or step are to be understood to be explicitly included in the description.

All numeric values herein are assumed to be modified by the term "about", whether or not explicitly indicated. For the purposes of the present invention, ranges may be expressed as from "about" one particular value to "about" another particular value. When such a range is expressed, another embodiment includes from the one particular value to the other particular value. The recitation of numerical ranges by endpoints includes all the numeric values subsumed within that range. A numerical range of one to five includes for example the numeric values 1, 1.5, 2, 2.75, 3, 3.80, 4, 5, and so forth. It will be further understood that the endpoints of each of the ranges are significant both in relation to the other endpoint, and independently of the other endpoint. When a value is expressed as an approximation by use of the antecedent "about," it will be understood that the particular value forms another embodiment. The term "about" generally refers to a range of numeric values that one of skill in the art would consider equivalent to the recited numeric value or having the same function or result. Similarly, the antecedent "substantially" means largely, but not wholly, the same form, manner or degree and the particular element will have a range of configurations as a person of ordinary skill in the art would consider as having the same function or result. When a particular element is expressed as an approximation by use of the antecedent "substantially," it will be understood that the particular element forms another embodiment.

Moreover, for the purposes of the present invention, the term "a" or "an" entity refers to one or more of that entity unless otherwise limited. As such, the terms "a" or "an", "one or more" and "at least one" can be used interchangeably herein.

Further, for the purposes of the present invention, the term "coupled", "connected" or derivatives thereof can mean indirectly coupled or connected or integrated with, depending upon the embodiment.

Additionally, for the purposes of the present invention, the term "integrated" when referring to two or more components means that the components (i) can be united to provide a one-piece construct, a monolithic construct, or a unified whole, or (ii) can be formed as a one-piece construct, a monolithic construct, or a unified whole. Said another way, the components can be integrally formed, meaning connected together so as to make up a single complete piece or unit, or so as to work together as a single complete piece or unit, and so as to be incapable of being easily dismantled without destroying the integrity of the piece or unit.

Thus, the applicant(s) should be understood to claim at least: i) each of the combinations and extinguisher assemblies herein disclosed and described, ii) the related methods disclosed and described, iii) similar, equivalent, and even implicit variations of each of these constructions and methods, iv) those alternative embodiments which accomplish each of the functions shown, disclosed, or described, v) those alternative designs and methods which accomplish each of the functions shown as are implicit to accomplish that which is disclosed and described, vi) each feature, component, and step shown as separate and independent inventions, vii) the applications enhanced by the various systems or components disclosed, viii) the resulting products produced by such systems or components, ix) methods and apparatuses substantially as described hereinbefore and with reference to any of the accompanying examples, x) the various combinations and permutations of each of the previous elements disclosed.

The claims set forth in this specification are hereby incorporated by reference as part of this description of the invention, and the applicant expressly reserves the right to use all of or a portion of such incorporated content of such claims as additional description to support any of or all of the claims or any element or component thereof, and the applicant further expressly reserves the right to move any portion of or all of the incorporated content of such claims or any element or component thereof from the description into the claims or vice-versa as necessary to define the matter for which protection is sought by this application or by any subsequent application or continuation, division, or continuation-in-part application thereof, or to obtain any benefit of, reduction in fees pursuant to, or to comply with the patent laws, rules, or regulations of any country or treaty, and such content incorporated by reference shall survive during the entire pendency of this application including any subsequent continuation, division, or continuation-in-part application thereof or any reissue or extension thereon. The elements following an open transitional phrase such as "comprising" may in the alternative be claimed with a closed transitional phrase such as "consisting essentially of" or "consisting of" whether or not explicitly indicated the description portion of the specification.

Additionally, the claims set forth in this specification are further intended to describe the metes and bounds of a limited number of the preferred embodiments of the invention and are not to be construed as the broadest embodiment of the invention or a complete listing of embodiments of the invention that may be claimed. The applicant does not waive any right to develop further claims based upon the description set forth above as a part of any continuation, division, or continuation-in-part, or similar application.

The invention claimed is:

1. A gunsight comprising:

a support having a support exterior surface, said support exterior surface having a support exterior surface first section and a support exterior surface second section, a hollow delimited by a support interior surface of said support, said support exterior surface second section forms a curve;

an elongate light collector having a light collector first section connected to a light collector curved second section, a terminal connected to said light collector curved second section, and an illuminating surface at said light collector first section;

a light generating source proximate said terminal; wherein, said light collector first section lies on and along said support exterior surface first section;

said light collector curved second section lies on and along said curve of said support exterior surface second section; and said light generating source resides in said hollow.

2. A gunsight comprising:

a support having a support exterior surface, said support exterior surface having a support exterior surface first section and a support exterior surface second section, a hollow delimited by a support interior surface of said support, said support exterior surface second section forms a curve;

an elongate light collector having a light collector first section connected to a light collector curved second section, a terminal connected to said light collector curved second section, and an illuminating surface at said light collector first section;

a light generating source proximate said terminal; wherein, said light collector first section lies on and along said support exterior surface first section;

said light collector curved second section lies on and along said curve of said support exterior surface second section;

said light generating source resides in said hollow;

said terminal comprises an exterior surface tapering radially inward towards a longitudinal axis of said terminal and tapering in a direction going downstream away from a terminal end surface.

3. The gunsight of claim 2, wherein, said longitudinal axis of said terminal extends orthogonal to a longitudinal axis of said light collector first section.

4. The gunsight of claim 1, further comprising:

a light generating source housing residing in said hollow; and wherein, said light generating source resides in said light generating source housing.

5. The gunsight of claim 1, wherein said light collector comprises:

a light collector third section upstream of said light collector curved second section; and wherein, said light collector curved second section interconnects said light collector first and third sections.

6. The gunsight of claim 5, wherein a longitudinal axis of said light collector third section extends orthogonal to a longitudinal axis of said light collector first section.

7. The gunsight of claim 5, wherein a longitudinal axis of said light collector third section extends parallel to a longitudinal axis of said light collector first section.

8. The gunsight of claim 5, wherein a longitudinal axis of said light collector third section extends at an angle of from about 10 degrees to about 85 degrees relative to a longitudinal axis of said light collector first section.

9. The gunsight of claim 3, wherein said light collector comprises:

a light collector third section upstream of said light collector curved second section; wherein, said light collector curved second section interconnects said light collector first and third sections; and said light collector third section interconnects said terminal to said light collector curved second section.

10. A gunsight comprising:

a support having a support exterior surface, said support exterior surface having a support exterior surface first section and a support exterior surface second section, a hollow delimited by a support interior surface of said support, said support exterior surface second section forms a curve;

an elongate light collector having a light collector first section connected to a light collector curved second section, a terminal connected to said light collector curved second section, and an illuminating surface at said light collector first section;

a light generating source proximate said terminal; wherein, said light collector first section lies on and along said support exterior surface first section;

said light collector curved second section lies on and along said curve of said support exterior surface second section;

said light generating source resides in said hollow;

a carrier, said support exterior surface first section and said support exterior surface second section formed with said carrier; and an enclosure delimiting an open space having a first and opposite second access into said open space, said enclosure formed with said carrier, said light collector first section in said enclosure.

11. The gunsight of claim 10, wherein said carrier comprises:

a holder, said support exterior surface first section and said support exterior surface second section formed with said holder; and a carrier base delimiting said hollow having said light generating source.

12. The gunsight of claim 11, wherein said support further comprises:

a carrier housing having a pair of spaced apart walls delimiting an open space between said walls;

a support base; wherein, said carrier disposed in said carrier housing;

said light collector in said open space delimited by said walls; and said carrier housing pivotably coupled to said support base.

13. The gunsight of claim 12, wherein, said carrier is adjustable in a first and opposite second direction relative to said carrier housing along a longitudinal axis of said carrier.

14. The gunsight of claim 10, wherein, said support exterior surface first section forms a first section of a carrier first surface portion of said carrier; said support exterior surface second section forms a second section of said carrier first surface portion;

said light collector first section forms a first section of a first light collector; said light collector curved second section forms a second section of said first light collector; said terminal forms a first light collector terminal; said illuminating surface forms a first light collector illuminating surface;

said enclosure forms a first enclosure having an end surface delimiting said first access;

said gunsight further comprising:

a second elongate light collector having a second light collector first section connected to a second light collector curved second section, a second light collector terminal connected to said second light collector curved second section, and a second light collector illuminating surface at said second light collector first section;

a carrier second surface portion of said carrier, said carrier second surface portion having first and second sections, said second section having a curve, said first and second sections of said carrier second surface portion formed with said carrier;

a second enclosure delimiting an open space having a first and opposite second access into said open space, said second enclosure having an end surface delimiting said first access, said second enclosure formed with said carrier; wherein, said second light collector first section in said open space delimited by said second enclosure;

said first and second enclosures delimit an open space of a sighting notch; said end surfaces of said enclosures form the entry into said open space of said sighting notch;

said second light collector first section lies on and along said first section of said carrier second surface portion; and said light collector second section lies on and along said curve of said second section of said carrier second surface portion.

15. The gunsight of claim 12, further comprising:

a connector connected to said support;

wherein said connector further comprises a guide adjustable laterally in a direction along a longitudinal axis of said support base.

16. The gunsight of claim 15, wherein said connector further comprises a set screw operable to adjust said guide.

17. The gunsight of claim 10, wherein said support exterior surface first and second sections each comprise a groove.

18. The gunsight of claim 14, wherein said carrier first and second surface portions each comprise a groove.

19. The gunsight of claim 10, wherein, said light collector configured to direct light from said light generating source downstream along said light collector curved second and first sections to said illuminating surface.

20. The gunsight of claim 19, wherein, said light collector configured to collect ambient light and direct said collected ambient light to said illuminating surface.

21. The gunsight of claim 1, wherein said light generating source comprises tritium.

22. A gunsight comprising:

a support having a support exterior surface comprising a support exterior surface curved section;

an elongate light collector having a light collector curved section which lies on said support exterior surface curved section, said light collector comprising an illuminating surface opposite a terminal;

a hollow delimited by a support interior surface of said support; and a light generating source disposed in said hollow proximate said terminal.

* * * * *